US008936342B2

(12) United States Patent
Ueshima

(10) Patent No.: US 8,936,342 B2
(45) Date of Patent: Jan. 20, 2015

(54) IMAGE RECORDING APPARATUS AND RECORDING DEFECT INSPECTION METHOD FOR SAME

(71) Applicant: FUJIFILM Corporation, Tokyo (JP)

(72) Inventor: Masashi Ueshima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/763,496

(22) Filed: Feb. 8, 2013

(65) Prior Publication Data

US 2013/0208042 A1 Aug. 15, 2013

(30) Foreign Application Priority Data

Feb. 10, 2012 (JP) ..... 2012-027615

(51) Int. Cl.
*B41J 29/393* (2006.01)
*B41J 2/21* (2006.01)
*B41J 2/165* (2006.01)

(52) U.S. Cl.
CPC ..... *B41J 29/393* (2013.01); *B41J 2/2142* (2013.01); *B41J 2/2146* (2013.01); *B41J 2/165* (2013.01)
USPC ..... 347/19

(58) Field of Classification Search
USPC ..... 347/19, 23
See application file for complete search history.

(56) References Cited

U.S. PATENT DOCUMENTS

2007/0229578 A1 10/2007 Yokozawa et al.
2010/0321431 A1 12/2010 Mori

FOREIGN PATENT DOCUMENTS

JP H03-257538 A 11/1991
JP 2001-310478 A 11/2001
JP 2005-219486 A 8/2005
JP 2007-216569 A 8/2007
JP 2007-290352 A 11/2007
JP 2011-051225 A 3/2011
JP 2011-167954 A 9/2011

OTHER PUBLICATIONS

The extended European Search Report dated May 28, 2013, which corresponds to EP Application No. 13154553.5-1701 and is related to U.S. Appl. No. 13/763,496.

(Continued)

*Primary Examiner* — Kristal Feggins
(74) *Attorney, Agent, or Firm* — Studebaker & Brackett PC

(57) ABSTRACT

An aspect of a recording defect inspection method for an image recording apparatus includes: a recording step of sequentially recording test patterns of respective recording heads onto a recording medium, an image capturing step of capturing an image of a test pattern recorded on the recording medium by means of a scanner, an analysis step of analyzing the captured test pattern and detecting a recording defect of the recording head which has recorded the test pattern, an evaluation frequency setting step of setting an evaluation frequency for each of the recording heads on the basis of a recording defect occurrence frequency for each recording head, and a control step of setting a frequency of each of the recording heads in the test patterns to the set evaluation frequency.

16 Claims, 18 Drawing Sheets

(56) References Cited

OTHER PUBLICATIONS

An Office Action; "Notification of Reasons for Rejection," issued by the Japanese Patent Office on Dec. 11, 2013, which corresponds to Japanese Patent Application No. 2012-027615 and is related to U.S. Appl. No. 13/763,496; with partial translation.

An Office Action; "Notification of Reasons for Rejection," issued by the Japanese Patent Office on Sep. 22, 2014, which corresponds to Japanese Patent Application No. 2012-027615 and is related to U.S. Appl. No. 13/763,496; with partial translation.

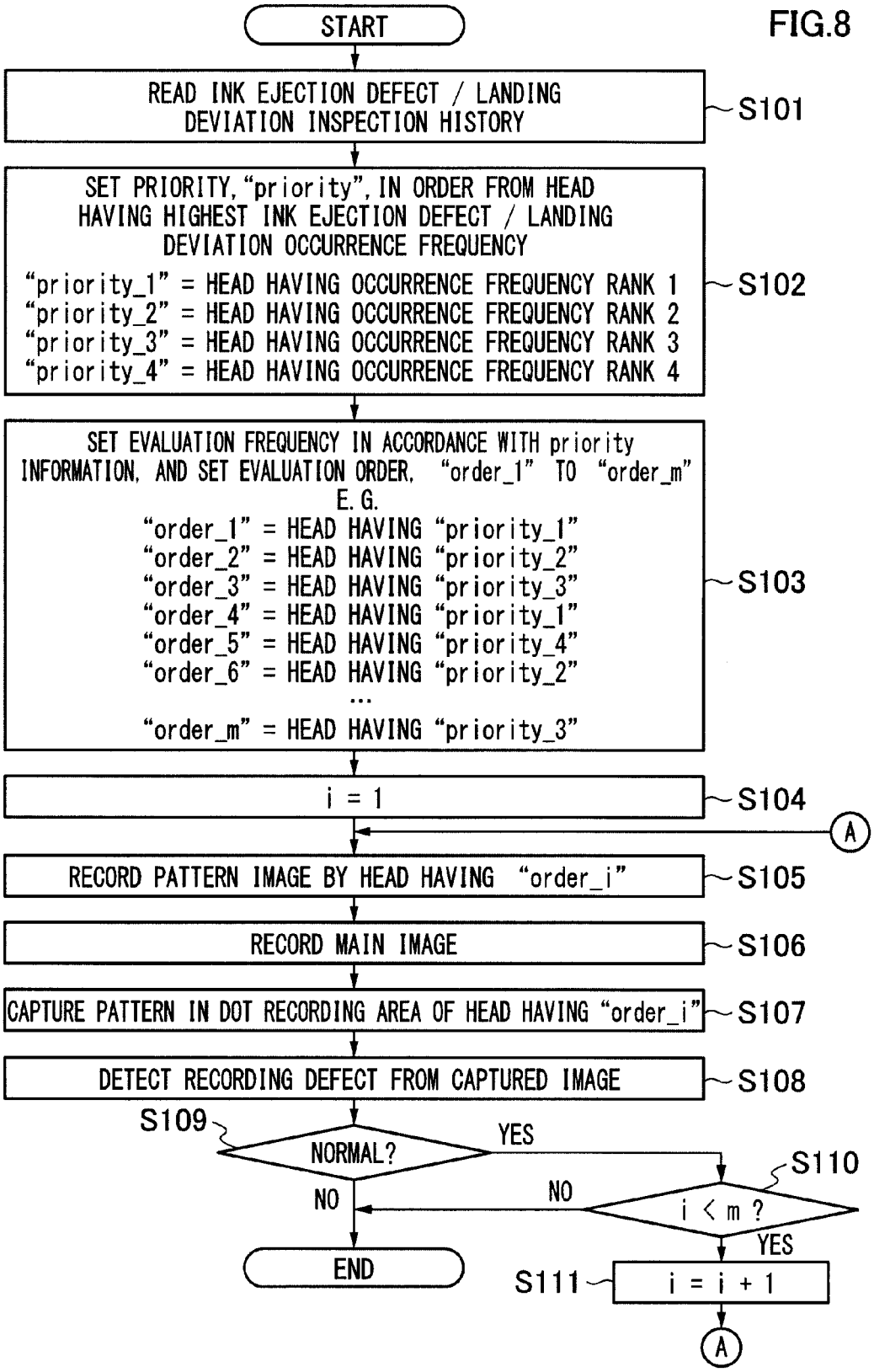
FIG.8
START
READ INK EJECTION DEFECT / LANDING DEVIATION INSPECTION HISTORY
S101
SET PRIORITY, "priority", IN ORDER FROM HEAD HAVING HIGHEST INK EJECTION DEFECT / LANDING DEVIATION OCCURRENCE FREQUENCY
"priority_1" = HEAD HAVING OCCURRENCE FREQUENCY RANK 1
"priority_2" = HEAD HAVING OCCURRENCE FREQUENCY RANK 2
"priority_3" = HEAD HAVING OCCURRENCE FREQUENCY RANK 3
"priority_4" = HEAD HAVING OCCURRENCE FREQUENCY RANK 4
S102
SET EVALUATION FREQUENCY IN ACCORDANCE WITH priority INFORMATION, AND SET EVALUATION ORDER, "order_1" TO "order_m"
E. G.
"order_1" = HEAD HAVING "priority_1"
"order_2" = HEAD HAVING "priority_2"
"order_3" = HEAD HAVING "priority_3"
"order_4" = HEAD HAVING "priority_1"
"order_5" = HEAD HAVING "priority_4"
"order_6" = HEAD HAVING "priority_2"
...
"order_m" = HEAD HAVING "priority_3"
S103
i = 1
S104
A
RECORD PATTERN IMAGE BY HEAD HAVING "order_i"
S105
RECORD MAIN IMAGE
S106
CAPTURE PATTERN IN DOT RECORDING AREA OF HEAD HAVING "order_i"
S107
DETECT RECORDING DEFECT FROM CAPTURED IMAGE
S108
S109
NORMAL?
YES
NO
S110
NO
i < m ?
YES
END
S111
i = i + 1
A 206a

| INK COLOR | NO. OF OCCURRENCES |
|---|---|
| CYAN | 203 |
| MAGENTA | 48 |
| YELLOW | 86 |
| BLACK | 149 |

206b

| INK COLOR | HEAD MODULE NO. | NO. OF OCCURRENCES |
|---|---|---|
| CYAN | 1 | 37 |
| | 2 | 41 |
| | 3 | 27 |
| | ~ | ~ |
| | 6 | 30 |
| MAGENTA | 1 | 7 |
| | 2 | 9 |
| | 3 | 11 |
| | ~ | ~ |
| | 6 | 5 |
| YELLOW | 1 | 17 |
| | 2 | 21 |
| | 3 | 10 |
| | ~ | ~ |
| | 6 | 5 |
| BLACK | 1 | 21 |
| | 2 | 12 |
| | 3 | 39 |
| | ~ | ~ |
| | 6 | 27 |

206c

| INK COLOR | HEAD MODULE NO. | NOZZLE NO. | NO. OF OCCURRENCES |
|---|---|---|---|
| CYAN | 1 | 1 | 3 |
| | | ~ | ~ |
| | | 636 | 1 |
| | ~ | ~ | ~ |
| | 6 | 1 | 2 |
| | | ~ | ~ |
| | | 636 | 0 |
| MAGENTA | 1 | 1 | 0 |
| | | ~ | ~ |
| | | 636 | 1 |
| | ~ | ~ | ~ |
| | 6 | 1 | 0 |
| | | ~ | ~ |
| | | 636 | 0 |
| YELLOW | 1 | 1 | 0 |
| | | ~ | ~ |
| | | 636 | 0 |
| | ~ | ~ | ~ |
| | 6 | 1 | 1 |
| | | ~ | ~ |
| | | 636 | 0 |
| BLACK | 1 | 1 | 1 |
| | | ~ | ~ |
| | | 636 | 0 |
| | ~ | ~ | ~ |
| | 6 | 1 | 0 |
| | | ~ | ~ |
| | | 636 | 2 |

FIG.9

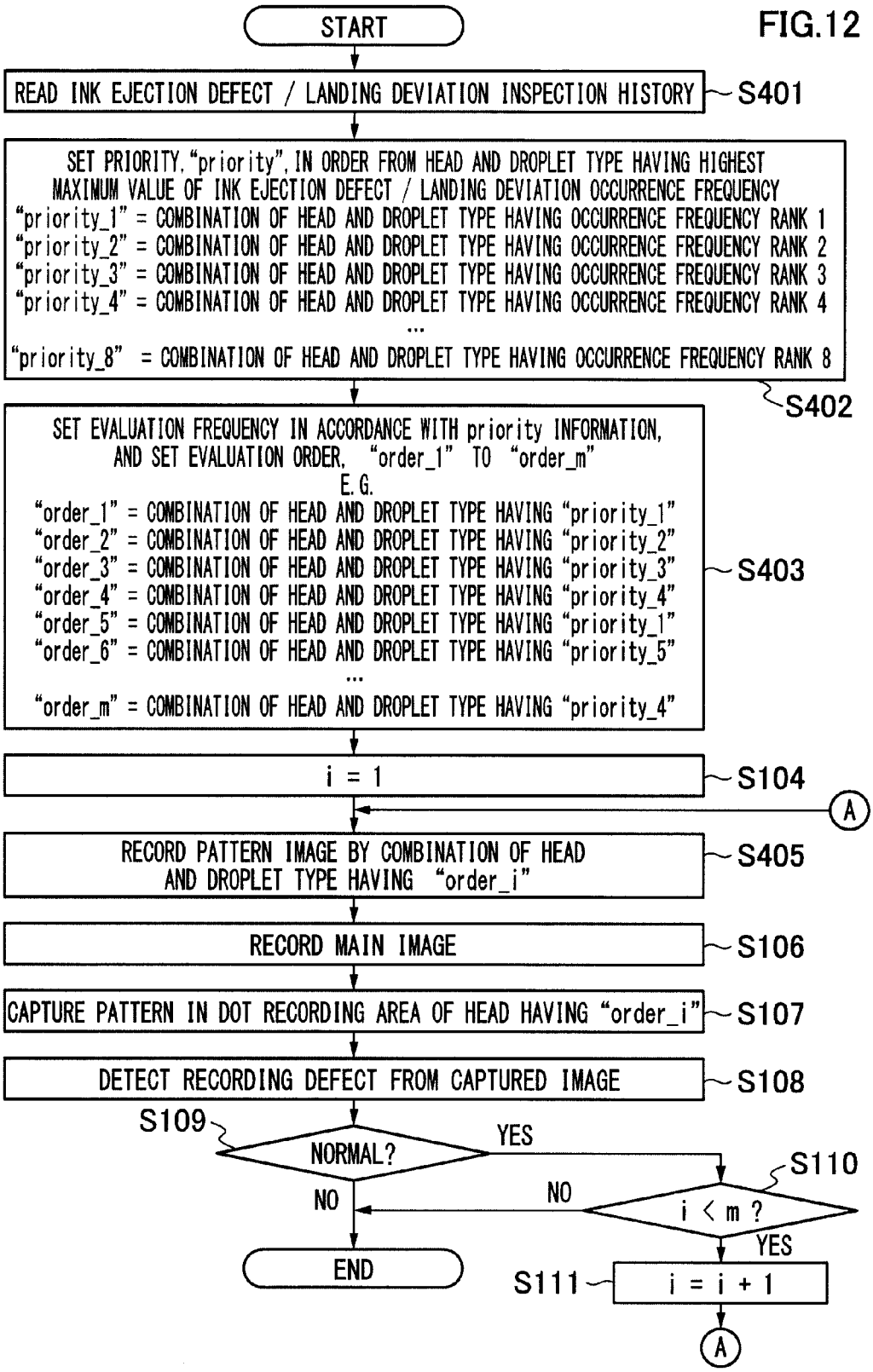
FIG.12
START
READ INK EJECTION DEFECT / LANDING DEVIATION INSPECTION HISTORY
S401
SET PRIORITY, "priority", IN ORDER FROM HEAD AND DROPLET TYPE HAVING HIGHEST MAXIMUM VALUE OF INK EJECTION DEFECT / LANDING DEVIATION OCCURRENCE FREQUENCY
"priority_1" = COMBINATION OF HEAD AND DROPLET TYPE HAVING OCCURRENCE FREQUENCY RANK 1
"priority_2" = COMBINATION OF HEAD AND DROPLET TYPE HAVING OCCURRENCE FREQUENCY RANK 2
"priority_3" = COMBINATION OF HEAD AND DROPLET TYPE HAVING OCCURRENCE FREQUENCY RANK 3
"priority_4" = COMBINATION OF HEAD AND DROPLET TYPE HAVING OCCURRENCE FREQUENCY RANK 4
...
"priority_8" = COMBINATION OF HEAD AND DROPLET TYPE HAVING OCCURRENCE FREQUENCY RANK 8
S402
SET EVALUATION FREQUENCY IN ACCORDANCE WITH priority INFORMATION, AND SET EVALUATION ORDER, "order_1" TO "order_m"
E.G.
"order_1" = COMBINATION OF HEAD AND DROPLET TYPE HAVING "priority_1"
"order_2" = COMBINATION OF HEAD AND DROPLET TYPE HAVING "priority_2"
"order_3" = COMBINATION OF HEAD AND DROPLET TYPE HAVING "priority_3"
"order_4" = COMBINATION OF HEAD AND DROPLET TYPE HAVING "priority_4"
"order_5" = COMBINATION OF HEAD AND DROPLET TYPE HAVING "priority_1"
"order_6" = COMBINATION OF HEAD AND DROPLET TYPE HAVING "priority_5"
...
"order_m" = COMBINATION OF HEAD AND DROPLET TYPE HAVING "priority_4"
S403
i = 1
S104
A
RECORD PATTERN IMAGE BY COMBINATION OF HEAD AND DROPLET TYPE HAVING "order_i"
S405
RECORD MAIN IMAGE
S106
CAPTURE PATTERN IN DOT RECORDING AREA OF HEAD HAVING "order_i"
S107
DETECT RECORDING DEFECT FROM CAPTURED IMAGE
S108
S109
NORMAL?
YES
NO
S110
i < m ?
NO
YES
END
S111
i = i + 1
A

FIG.13

206d

| INK COLOR | DROPLET TYPE | NO. OF OCCURRENCES |
|---|---|---|
| CYAN | LARGE | 203 |
| | SMALL | 100 |
| MAGENTA | LARGE | 48 |
| | SMALL | 20 |
| YELLOW | LARGE | 86 |
| | SMALL | 30 |
| BLACK | LARGE | 149 |
| | SMALL | 40 |

FIG.16

206e

| INK COLOR | HEAD MODULE NO. | NO. OF LARGE DROPLETS | NO. OF SMALL DROPLETS |
|---|---|---|---|
| CYAN | 1 | 32 | 5 |
| | 2 | 31 | 10 |
| | 3 | 18 | 9 |
| | ~ | ~ | ~ |
| | 6 | 28 | 2 |
| MAGENTA | 1 | 6 | 1 |
| | 2 | 9 | 0 |
| | 3 | 8 | 3 |
| | ~ | ~ | ~ |
| | 6 | 5 | 0 |
| YELLOW | 1 | 11 | 6 |
| | 2 | 13 | 8 |
| | 3 | 9 | 1 |
| | ~ | ~ | ~ |
| | 6 | 4 | 1 |
| BLACK | 1 | 20 | 1 |
| | 2 | 10 | 2 |
| | 3 | 30 | 9 |
| | ~ | ~ | ~ |
| | 6 | 21 | 6 |

IMAGE RECORDING APPARATUS AND RECORDING DEFECT INSPECTION METHOD FOR SAME

BACKGROUND OF THE INVENTION

1. Field of the Invention

The present invention relates to an image recording apparatus and a recording defect inspection method for same, and more particularly, to technology for detecting defective recording elements by reading recorded test patterns.

2. Description of the Related Art

An inkjet recording apparatus is known which records an image by ejecting ink onto a recording medium using a recording head in which a plurality of nozzles that eject ink are arranged. In an inkjet recording apparatus, ejection failure caused by nozzle blockages may occur, as may nozzles having recording defects, such as landing deviations, caused by partial closing off of the nozzles. If a nozzle having an ejection failure or a nozzle having landing deviation arises, then a white stripe occurs in the output image.

On the other hand, technology is also known according to which test patterns for measuring recording characteristics of a recording head are output, and ejection failure nozzles and nozzles having landing deviation are detected on the basis of the results of measuring the density of these test patterns. In this way, by previously detecting ejection failure nozzles and nozzles having landing deviation, image correction using normally functioning nozzles becomes possible.

However, the work of inspecting ejection defects and landing deviations generally requires a long inspection time. In cases where an ejection defect or landing deviation has occurred in the test patterns that are the object of inspection, if the test patterns are inspected in sequence starting from an inspection object range corresponding to a recording head which has a low defect occurrence frequency, inspection also needs to be carried out in respect of test patterns in which no defects have occurred and therefore it takes time to determine the location of defects. If detection takes a long time, then countermeasures for dealing with the defective locations are delayed.

In view of problems of this kind, Japanese Patent Application Publication No. 2011-51225 discloses technology for evaluating respective recording defect occurrence forecasts for a plurality of recording heads, and analyzing test patterns in sequence starting from a head having the highest defect occurrence forecast. According to this technology, it is possible to shorten the time taken to detect ejection failure nozzles or nozzles having landing deviation.

SUMMARY OF THE INVENTION

However, Japanese Patent Application Publication No. 2011-51225 has a drawback of not taking account of the evaluation frequency in the analysis of test patterns.

The present invention was devised in view of these circumstances, an object thereof being to provide an image recording apparatus and a recording defect inspection method whereby a defective recording element is detected at an early stage.

In order to achieve the above object, an aspect of a recording defect inspection method for an image recording apparatus includes a recording step of sequentially recording test patterns of respective recording heads onto a recording medium, an image capturing step of capturing an image of a test pattern recorded on the recording medium by means of a scanner, an analysis step of analyzing the captured test pattern and detecting a recording defect of the recording head which has recorded the test pattern, an evaluation frequency setting step of setting an evaluation frequency for each of the recording heads on the basis of a recording defect occurrence frequency for each recording head, and a control step of setting the set evaluation frequency as a frequency of analysis and detection for each of the recording heads in the analysis step.

According to the present aspect of the invention, since an evaluation frequency for each recording head is set on the basis of a recording defect occurrence frequency for each recording head, and the set evaluation frequency is set as a frequency of analysis and detection for each recording head, then it is possible to detect defective recording elements at an earlier stage.

It is preferable that the control step specifies a recording head which is to record a test pattern in the recording step on the basis of the set evaluation frequency, and the recording step records a test pattern on the recording medium by the specified recording head. According to the present aspect, since a test pattern is recorded by the recording head specified on the basis of the set evaluation frequency, it is possible to set the frequency of each recording head in the test patterns that are analyzed in the analysis step to the set evaluation frequency.

It is preferable that the control step includes an evaluation order setting step of setting an evaluation order for the plurality of recording heads on the basis of the set evaluation frequency, and the recording step records a test pattern on the recording medium in accordance with the set evaluation order. According to the aspect, since a test pattern is recorded in accordance with the set evaluation order, it is possible to set the frequency of each recording head in the test patterns that are analyzed in the analysis step to the set evaluation frequency.

It is preferable that the evaluation frequency setting step raises an evaluation frequency of a recording head having a high recording defect occurrence frequency, of the plurality of recording heads. According to the aspect, it is possible to detect recording defect at an early stage.

It is preferable that the evaluation frequency setting step sets a priority order for each recording head on the basis of a recording defect occurrence frequency of each recording head, and sets an evaluation frequency for each recording head on the basis of the set priority order. According to the aspect, since an evaluation frequency is set on the basis of the priority order, it is possible to set the evaluation frequency appropriately.

It is preferable that the evaluation frequency setting step acquires information relating to factors causing a recording defect, and the recording defect occurrence frequency is calculated on the basis of the acquired information. According to the aspect, since the recording defect occurrence frequency is appropriately calculated, it is possible to set the evaluation frequency for each recording head appropriately.

It is preferable that the information relating to factors causing a recording defect is recording defect history information of the respective recording heads. The information may also be information relating to image data that is to be output.

It is preferable that the recording head records on the recording medium by ink, and the information relating to factors causing a recording defect is the viscosity of the respective inks. The information may also be vapor pressures of respective inks.

Further, the recording head may have a plurality of nozzles which eject ink by an inkjet method, and the information relating to factors causing a recording defect may be nozzle hole diameters of the respective recording heads.

Furthermore, the information relating to factors causing a recording defect may be an installation angle of the respective recording heads on a main body of the image recording apparatus.

It is preferable that the recording head can record dot sizes of at least two types, and that the evaluation frequency setting step sets an evaluation frequency for each combination of a dot size and a recording head, on the basis of a recording defect occurrence frequency for each combination of the dot size and recording head, the recording step sequentially records a test pattern for each combination of the dot size and recording head, on a recording medium, and the control step sets the set evaluation frequency as the frequency of analysis and detection for each combination of the dot size and the recording head in the analysis step.

Therefore, it is possible to detect recording defects efficiently for each combination of dot size and recording head, in respect of recording heads that are capable of recording a plurality of dot sizes.

It is preferable that the method further includes a reporting step of immediately issuing a report that a recording defect has been detected, when a recording defect is detected in the analysis step. Moreover, the analysis step may immediately terminate analysis, when a recording defect has been detected.

In order to achieve the above object, an aspect of an image recording apparatus includes a plurality of recording heads, an evaluation frequency setting device which sets an evaluation frequency for each recording head on the basis of a recording defect occurrence frequency for each of the recording heads, a test pattern recording device which sequentially records a test pattern for each of the recording heads onto a recording medium, an image capturing device which captures an image of a test pattern recorded on the recording medium, an analysis device which analyzes the image-captured test pattern to detect a recording defect in the recording head which has recorded the test pattern, and a control device which sets the set evaluation frequency as a frequency of analysis and detection for each of the recording heads by the analysis device.

According to the present invention, it is possible to detect defective recording elements at an early stage.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 8 is a flowchart showing a defective nozzle detection process according to a first embodiment;

FIG. 9 is a diagram showing one example of an ink ejection defect and landing deviation inspection history;

FIG. 12 is a flowchart showing a defective nozzle detection process according to a third embodiment;

FIG. 13 is a diagram showing one example of an ink ejection defect and landing deviation inspection history;

FIG. 16 is a diagram showing one example of an ink ejection defect and landing deviation inspection history;

DETAILED DESCRIPTION OF THE PREFERRED EMBODIMENTS

General Composition of Inkjet Recording Apparatus

Figure 1:
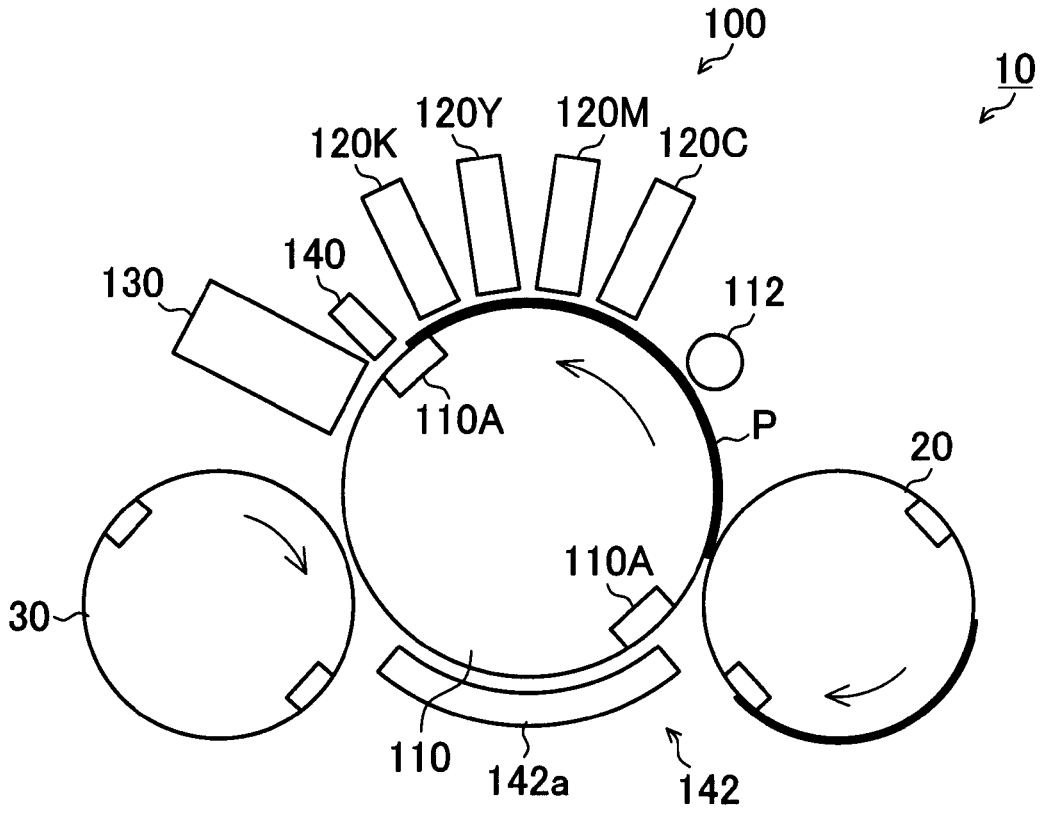
FIG. 1 is a general schematic drawing showing one embodiment of an inkjet recording apparatus.

FIG. 1 is a general schematic drawing showing one embodiment of an inkjet recording apparatus (which corresponds to an image recording apparatus) relating to the present invention.

This inkjet recording apparatus 10 is a cut sheet-type of aqueous inkjet printer which records an image by an inkjet method using aqueous ink on paper P (which corresponds to a recording medium), and is principally constituted by a paper supply unit (not illustrated) which supplies paper P, an image recording unit 100 which records an image by an inkjet method using aqueous ink on a surface (printing surface) of paper P supplied from the paper supply unit, and a paper output unit (not illustrated) which outputs paper P on which an image has been recorded in the image recording unit 100.

(Image Recording Unit)

The image recording unit 100 forms a color image on the printing surface of the paper P by ejecting droplets of inks (aqueous inks) of the respective colors of C, M, Y and K onto the printing surface of the paper P. The image recording unit 100 is principally constituted by an image recording drum 110 which conveys paper P, a paper pressing roller 112 which presses the paper P conveyed by the image recording drum 110 and causes the paper P to make tight contact with the image recording drum 110, inkjet heads (corresponding to a recording head, simply called "head" below) 120C, 120M, 120Y and 120K which eject ink droplets of respective color of cyan (C), magenta (M), yellow (Y) and black (K) on paper P, an image capturing unit 130 which reads in an image recorded on the paper P, a mist filter 140 which captures ink mist, and a drum temperature adjustment unit 142.

The image recording drum 110 is a conveyance device for paper P in the image recording unit 100. The image recording drum 110 is formed in a round cylindrical shape and is caused to rotate by being driven by a motor (not illustrated). A gripper 110A is provided on the outer circumferential surface of the paper supply drum 110, and a leading end of the paper P is gripped by this gripper 110A. The image recording drum 110 conveys the paper P while the paper P is wrapped about the circumferential surface of the drum, by gripping a leading end of the paper P with the gripper 110A and rotating. Furthermore, a plurality of suction holes (not illustrated) are formed in a prescribed pattern in the circumferential surface of the image recording drum 110. The paper P which is wrapped about the circumferential surface of the image recording drum 110 is conveyed while being held by suction on the circumferential surface of the image recording drum 110, by being suctioned via the suction holes. Consequently, it is possible to convey the paper P with a high degree of flatness.

The suctioning from the suction holes acts only in a fixed range, and acts only between a prescribed suction start position and a prescribed suction end position. The suction start position is set at the position where the paper pressing roller 112 is installed, and the suction end position is set on the downstream side of the position where the image capturing unit 130 is installed (for example, a position where the paper is transferred to the conveyance drum 30 of the next stage). More specifically, the suction region is set in such a manner that paper P is suctioned and held against the circumferential surface of the image recording drum 110 at least at the ink droplet ejection positions of the heads 120C, 120M, 120Y and 120K and at the image reading position of the image capturing unit 130.

The mechanism for suctioning and holding the paper P on the circumferential surface of the image recording drum 110 is not limited to a suctioning method based on negative pressure as described above, and it is also possible to employ a method based on electrostatic suction.

Furthermore, the image recording drum 110 according to the present embodiment is composed in such a manner that grippers 110A are provided in two positions on the outer circumferential surface, whereby two sheets of paper P can be conveyed in one revolution of the drum. Rotation of the conveyance drum 20 and the image recording drum 110 which convey the paper P from the paper supply unit to the image recording unit 100 is controlled so as to match the transfer timings of the sheets of paper P onto and off from the drums. In other words, the drums are driven so as to have the same circumferential speed, and are also driven in such a manner that the positions of the respective grippers match each other.

The paper pressing roller 112 is arranged in the vicinity of the paper reception position on the image recording drum 110 (the position where the paper P is received from the conveyance drum 20). The paper pressing roller 112 is constituted by a rubber roller and is installed so as to be abutted and pressed against the circumferential surface of the image recording drum 110. The paper P which has been transferred from the conveyance drum 20 of the previous stage to the image recording drum 110 is nipped upon passing the paper pressing roller 112, and is caused to make tight contact with the circumferential surface of the image recording drum 110.

The four heads 120C, 120M, 120Y and 120K are arranged at a uniform spacing apart in the conveyance path of the paper P by the image recording drum 110. The heads 120C, 120M, 120Y and 120K are constituted by line heads corresponding the width of the paper. The heads 120C, 120M, 120Y and 120K are arranged in substantially perpendicular fashion to the conveyance direction of the paper P by the image recording drum 110, and are also arranged in such a manner that the nozzle surfaces thereof oppose the circumferential surface of the image recording drum 110. The heads 120C, 120M, 120Y and 120K record an image on the paper P conveyed by the image recording drum 110, by ejecting droplets of ink toward the image recording drum 110 from the nozzle rows formed on the nozzle surfaces.

The image capturing unit 130 is an image capturing device which captures an image recorded by the heads 120C, 120M, 120Y and 120K and is arranged on the downstream side of the head 120K which is disposed in the last position in the direction of conveyance of paper P by means of the image recording drum 110. The image capturing unit 130 includes a line sensor constituted by a solid image capturing element, such as a CCD or a CMOS, and a fixed-focus image capturing optical system, for example.

The mist filter 140 is arranged between the final inkjet head 120K and the image capturing unit 130, and captures ink mist by suctioning the air in the periphery of the image recording drum 110. In this way, by capturing the ink mist through suctioning air in the periphery to the image recording drum 110, it is possible to prevent infiltration of ink mist into the image capturing unit 130. By this means, it is possible to prevent the occurrence of reading errors, and the like.

The drum temperature adjustment unit 142 adjusts the temperature of the image recording drum 110 by blowing conditioned air onto the image recording drum 110. The drum cooling unit 142 is principally constituted by an air-conditioning unit (not illustrated), and a duct 142A which blows the conditioned air supplied from the air-conditioning unit onto the circumferential surface of the image recording drum 110. The duct 142A adjusts the temperature of the image recording drum 110 by blowing conditioned air onto the region of the image recording drum 110 apart from the conveyance region of the paper P. In the present embodiment, since the paper P is conveyed along the circular arc-shaped surface of substantially the upper half region of the image recording drum 110, the duct 142A adjusts the temperature of the image recording drum 110 by blowing conditioned air onto substantially the lower half region of the image recording drum 110. More specifically, a blowing port of the duct 142A is formed in a circular arc shape so as to cover substantially the lower half of the image recording drum 110, in such a manner that conditioned air strikes substantially the lower half region of the image recording drum 110.

Here, the temperature adjustment of the image recording drum 110 is specified in relation to the temperature of the heads 120C, 120M, 120Y and 120K (in particular, the temperature of the nozzle surfaces), in such a manner that the image recording drum 110 assumes a temperature lower than the temperature of the heads 120C, 120M, 120Y and 120K. By this means, it is possible to prevent the occurrence of condensation on the heads 120C, 120M, 120Y and 120K. More specifically, by making the temperature of the image recording drum 110 lower than the heads 120C, 120M, 120Y and 120K, it is possible to induce condensation on the image recording drum, and condensation occurring on the heads 120C, 120M, 120Y and 120K (and in particular, on the nozzle surfaces thereof) can be prevented.

The image recording unit 100 has the composition described above. The paper P transferred from the conveyance drum 20 is received by the image recording drum 110. The image recording drum 110 grips the leading end of the paper P, with the gripper 110A, and by rotating, conveys the paper P. The paper P which has been transferred to the image recording drum 110 passes the paper pressing roller 112 and is thereby caused to make tight contact with the circumferential surface of the image recording drum 110. Simultaneously with this, the paper is suctioned from the suction holes of the image recording drum 110 and is thereby suctioned and held on the outer circumferential surface of the image recording drum 110. The paper P is conveyed in this state and passes the heads 120C, 120M, 120Y and 120K. During this passage of the paper, the heads 120C, 120M, 120Y and 120K eject droplets of inks of the respective colors of C, M, Y and K onto the printing surface, thereby forming a color image on the printing surface.

The paper P on which an image has been recorded by the heads 120C, 120M, 120Y and 120K then passes the image capturing unit 130. The image recorded on the printing surface of the paper is read in while the paper passes the image capturing unit 130. This reading of the recorded image is carried out according to requirements, and inspection for ejection defects, and the like, is carried out on the basis of the read image. The image is read out while in a state of being suctioned and held on the image recording drum 110, and therefore it is possible to read the image with high accuracy. Furthermore, since the image is read immediately after image recording, then it is possible to detect abnormalities, such as ejection defects, straight away, and to take corresponding countermeasures swiftly. Consequently, it is possible to prevent wasteful recording, as well as being able to minimize the occurrence of wasted paper.

Thereupon, the suctioning of the paper P is released and the paper P is transferred to a conveyance drum 40 that conveys the paper P to the paper output unit.

<Constitutional Example of Inkjet Head>

Next, the structure of inkjet heads is described. The heads 120C, 120M, 120Y and 120K corresponding to respective colors have the same structure, and a reference numeral 120 is hereinafter designated to any of the heads.

Figure 2A:
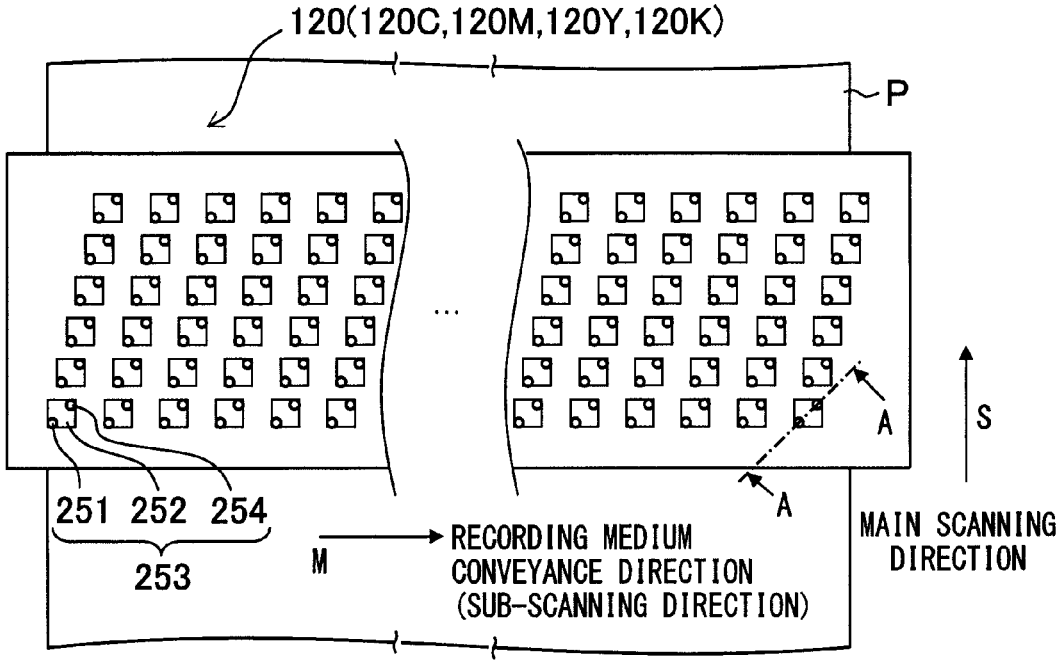
FIGS. 2A and 2B are diagrams showing an example of the structure of a head.
Figure 2B:
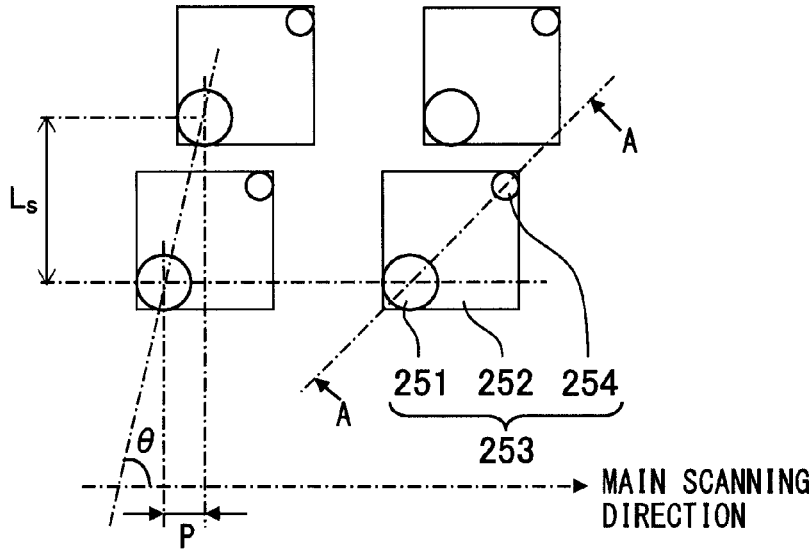
Figure 3A:
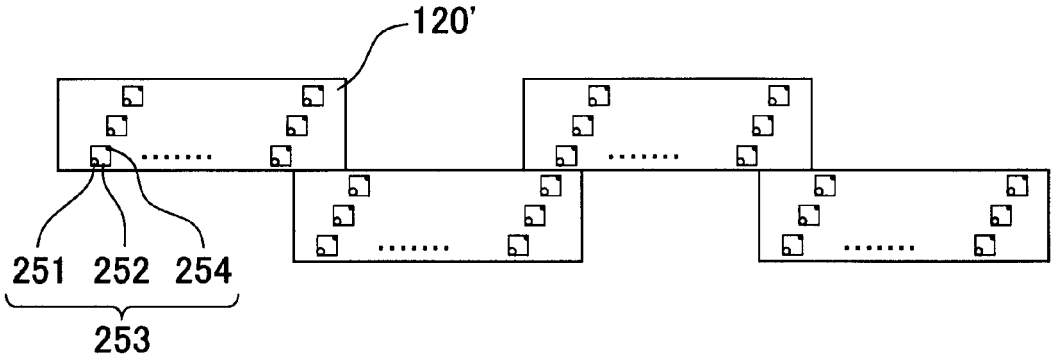
FIGS. 3A and 3B are diagrams showing a further example of the structure of a head.
Figure 3B:
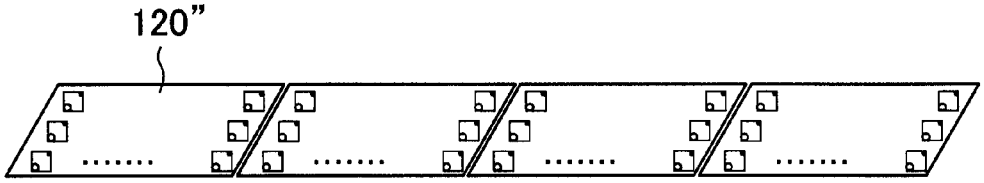
Figure 4:
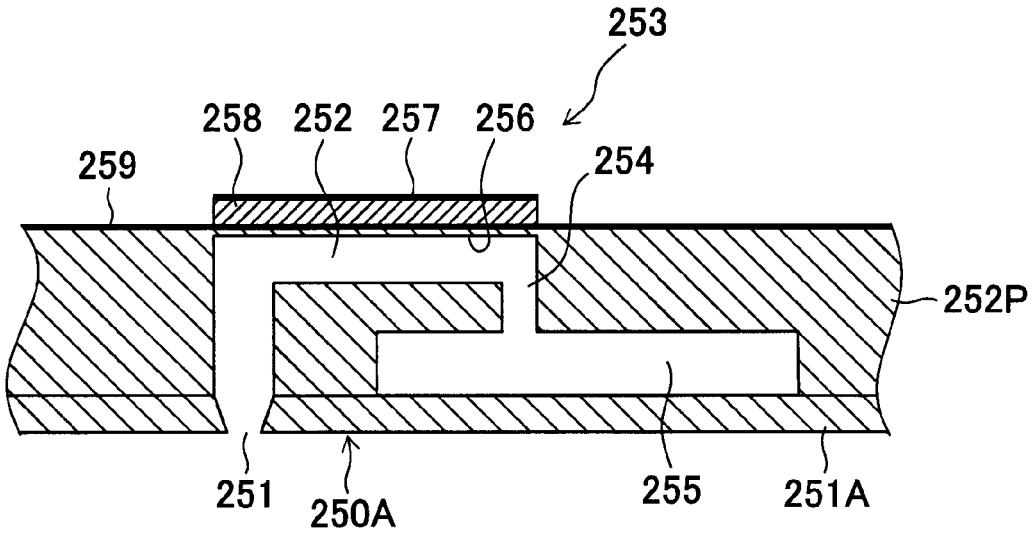
FIG. 4 is a cross-sectional diagram showing a three-dimensional composition of a droplet ejection element.

FIG. 2A is a plan perspective diagram illustrating an embodiment of the structure of a head 120, and FIG. 2B is a partial enlarged diagram of same. Moreover, FIGS. 3A and 3B are planar perspective views illustrating other structural embodiments of heads 120, and FIG. 4 is a cross-sectional diagram illustrating a liquid droplet ejection element for one channel being a recording element unit (an ink chamber unit corresponding to one nozzle 251) (a cross-sectional diagram along line A-A in FIGS. 2A and 2B).

As illustrated in FIGS. 2A and 2B, the head 120 according to the present embodiment has a structure in which a plurality of ink chamber units (liquid droplet ejection elements) 253, each having a nozzle 251 forming an ink droplet ejection aperture, a pressure chamber 252 corresponding to the nozzle 251, and the like, are disposed two-dimensionally in the form of a staggered matrix, and hence the effective nozzle interval (the projected nozzle pitch) as projected (orthographically-projected) in the lengthwise direction of the head (the direction perpendicular to the paper conveyance direction) is reduced and high nozzle density is achieved.

The mode of forming nozzle rows which have a length equal to or more than the entire width Wm of the recording area of the paper P in a direction (direction indicated by arrow M) substantially perpendicular to the paper conveyance direction (direction indicated by arrow S) of the paper P is not limited to the embodiment described above. For example, instead of the configuration in FIG. 2A, as illustrated in FIG. 3A, a line head having nozzle rows of a length corresponding to the entire width Wm of the recording area of the paper P can be formed by arranging and combining, in a staggered matrix, short head modules 120' having a plurality of nozzles 251 arrayed in a two-dimensional fashion. It is also possible to arrange and combine short head modules 120" in a line as shown in FIG. 3B.

The invention is not limited to a case where the full surface of the paper P is taken as the image forming range, and in cases where a portion of the surface of the paper P is taken as the image forming region (for example, if a non-image forming region is provided at the periphery of the paper, or the like), nozzle rows required for image formation in the prescribed image forming range should be formed.

The pressure chamber 252 provided to each nozzle 251 has substantially a square planar shape (see FIGS. 2A and 2B), and has an outlet port for the nozzle 251 at one of diagonally opposite corners and an inlet port (supply port) 254 for receiving the supply of the ink at the other of the corners. The planar shape of the pressure chamber 252 is not limited to this embodiment and can be various shapes including quadrangle (rhombus, rectangle, etc.), pentagon, hexagon, other polygons, circle, and ellipse.

As illustrated in FIG. 4, the head 120 is configured by stacking and joining together a nozzle plate 251A, in which the nozzles 251 are formed, a flow channel plate 252P, in which the pressure chambers 252 and the flow channels including the common flow channel 255 are formed, and the like. The nozzle plate 251A constitutes a nozzle surface (ink ejection surface) 250A of the head 120 and has formed therein the two-dimensionally arranged nozzles 251 communicating respectively to the pressure chambers 252.

The flow channel plate 252P constitutes lateral side wall parts of the pressure chamber 252 and serves as a flow channel formation member, which forms the supply port 254 as a limiting part (the narrowest part) of the individual supply channel leading the ink from a common flow channel 255 to the pressure chamber 252. FIG. 4 is simplified for the convenience of explanation, and the flow channel plate 252P may be structured by stacking one or more substrates.

The nozzle plate 251A and the flow channel plate 252P can be made of silicon and formed in the prescribed shapes by means of the semiconductor manufacturing process.

The common flow channel 255 is connected to an ink tank (not shown), which is a base tank for supplying ink, and the ink supplied from the ink tank is delivered through the common flow channel 255 to the pressure chambers 252.

A piezoelectric actuator 258 having an individual electrode 257 is connected on a diaphragm 256 constituting a part of faces (the ceiling face in FIG. 4) of the pressure chamber 252. The diaphragm 256 in the present embodiment is made of silicon having a nickel (Ni) conductive layer serving as a common electrode 259 corresponding to lower electrodes of a plurality of piezoelectric actuators 258, and also serves as the common electrode of the piezoelectric actuators 258, which are disposed on the respective pressure chambers 252. The diaphragm 256 can be formed by a non-conductive material such as resin; and in this case, a common electrode layer made of a conductive material such as metal is formed on the surface of the diaphragm member. It is also possible that the diaphragm is made of metal (an electrically-conductive material) such as stainless steel (SUS), which also serves as the common electrode.

When a drive voltage is applied between the individual electrode 257 and the common electrode 259, the piezoelectric actuator 258 is deformed, the volume of the pressure chamber 252 is thereby changed, and the pressure in the pressure chamber 252 is thereby changed, so that the ink inside the pressure chamber 252 is ejected through the nozzle 251. When the displacement of the piezoelectric actuator 258 is returned to its original state after the ink is ejected, new ink is refilled in the pressure chamber 252 from the common flow channel 255 through the supply port 254.

As illustrated in FIG. 2B, the plurality of ink chamber units 253 having the above-described structure are arranged in a prescribed matrix arrangement pattern in a line direction along the main scanning direction (the direction orthogonal to the paper P conveyance direction) and a column direction oblique at an angle of θ with respect to the main scanning direction, and thereby the high density nozzle head is formed in the present embodiment. In this matrix arrangement, the nozzles 251 can be regarded to be equivalent to those substantially arranged linearly at a fixed pitch $P=L_s/\tan\theta$ along the main scanning direction, where $L_s$ is a distance between the nozzles adjacent in the sub-scanning direction (the paper P conveyance direction).

In implementing the present invention, the mode of arrangement of the nozzles 251 in the head 120 is not limited to the embodiments in the drawings, and various nozzle arrangement structures can be employed. For example, instead of the matrix arrangement as described in FIGS. 2A and 2B, it is also possible to use a V-shaped nozzle arrangement, or an undulating nozzle arrangement, such as zigzag configuration (W-shape arrangement), which repeats units of V-shaped nozzle arrangements.

The devices which generate pressure (ejection energy) applied to eject droplets from the nozzles in the inkjet head is not limited to the piezoelectric actuator (piezoelectric elements), and can employ various pressure generation devices (energy generation devices), such as heaters in a thermal system (which uses the pressure resulting from film boiling by the heat of the heaters to eject ink) and various actuators in other systems. According to the ejection system employed in the head, the corresponding energy generation devices are arranged in the flow channel structure body.

<Conveyance System>

Figure 5:
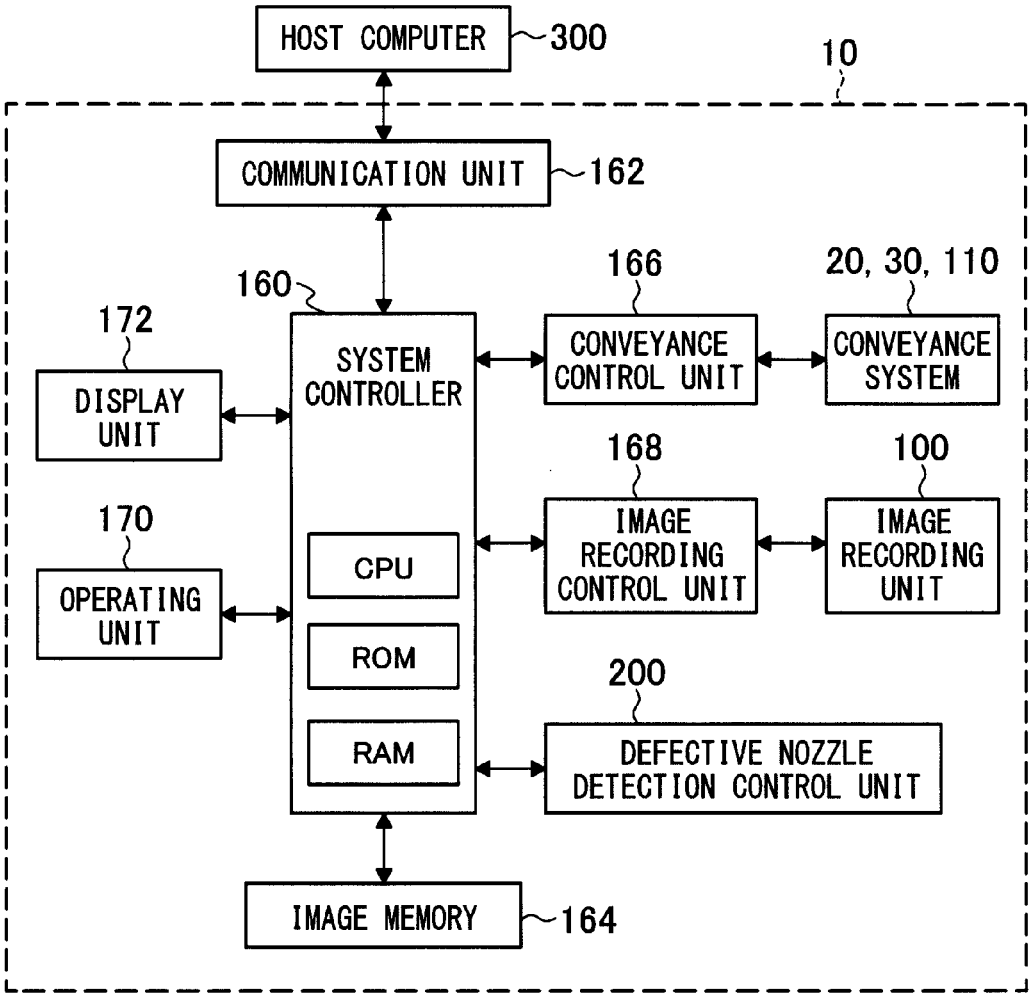
FIG. 5 is a block diagram showing the schematic composition of a control system of an inkjet recording apparatus.

FIG. 5 is a block diagram showing an approximate composition of a control system of an inkjet recording apparatus 10 according to the present embodiment.

As shown in FIG. 5, the inkjet recording apparatus 10 comprises a system controller 160, a communication unit 162, an image memory 164, a conveyance control unit 166, an image recording control unit 168, an operating unit 170, a display unit 172, a defective nozzle detection control unit 200, and the like.

The system controller 160 functions as a control device which performs overall control of the respective units of the inkjet recording apparatus 10, and also functions as a calculation device which performs various calculation processes. This system controller 160 includes a CPU, a ROM, a RAM and the like, and operates in accordance with a prescribed control program. A control program which is executed by the system controller 160 and various data required for control purposes are stored in a ROM.

The communication unit 162 includes a prescribed communications interface, and sends and receives data between the communications interface and a connected host computer 300.

The image memory 164 functions as a temporary storage device for various data including image data, and data is read from and written to the memory via the system controller 160. Image data which has been read in from a host computer 300 via the communications unit 162 is stored in the image memory 164.

The conveyance control unit 166 controls the conveyance system for the paper P in the inkjet recording apparatus 10. More specifically, the conveyance control unit 166 controls driving of the image recording drum 110 in the image recording unit 100, and also of the conveyance drum 20, and the conveyance drum 30.

The conveyance control unit 166 controls the conveyance system in accordance with instructions from the system controller 160, in such a manner that the paper P is conveyed smoothly.

The image recording control unit 168 controls the image recording unit 100 in accordance with the instructions from the system controller 160. More specifically, the driving of the heads 120C, 120M, 120Y and 120K is controlled in such a manner that a prescribed image is recorded on the paper P conveyed by the image recording drum 110.

The operating unit 170 comprises prescribed operating devices (for example, operating buttons, keyboard, touch panel, and the like), and outputs operating information input via the operating devices to the system controller 160. The system controller 160 executes various processing in accordance with the operational information input from the operating unit 170.

The display unit 172 includes a prescribed display apparatus (for example, an LCD panel, or the like), and causes prescribed information to be displayed on the display apparatus in accordance with instructions from the system controller 160.

The defective nozzle detection control unit 200 is described hereinafter.

As stated previously, image data to be recorded on the paper P is read into the inkjet recording apparatus 10 from the host computer 300 via the communications unit 162. The image data read in is stored in the image memory 164.

The system controller 160 generates dot data by carrying out prescribed signal processing on the image data stored in the image memory 164. The image recording control unit 168 then controls the driving of the heads 120C, 120M, 120Y and 120K of the image recording unit 100 in accordance with the generated dot data, so as to record an image represented by the image data, on the printing surface of the paper P.

In general, the dot data is generated by subjecting the image data to color conversion processing and halftone processing. The color conversion processing is processing for converting image data represented by sRGB, or the like (for example, RGB 8-bit image data) into ink volume data for each color of ink used by the inkjet recording apparatus 10 (in the present embodiment, ink volume data for the respective colors of C, M, Y and K). Halftone processing is processing for converting the ink volume data of the respective colors generated by the color conversion processing into dot data of respective colors by error diffusion processing, or the like.

The system controller 160 generates dot data of the respective colors by applying color conversion processing and halftone processing to the image data. An image represented by the image data is recorded on the paper P by controlling the driving of the corresponding inkjet heads in accordance with the dot data for the respective colors thus generated.

Figure 6:
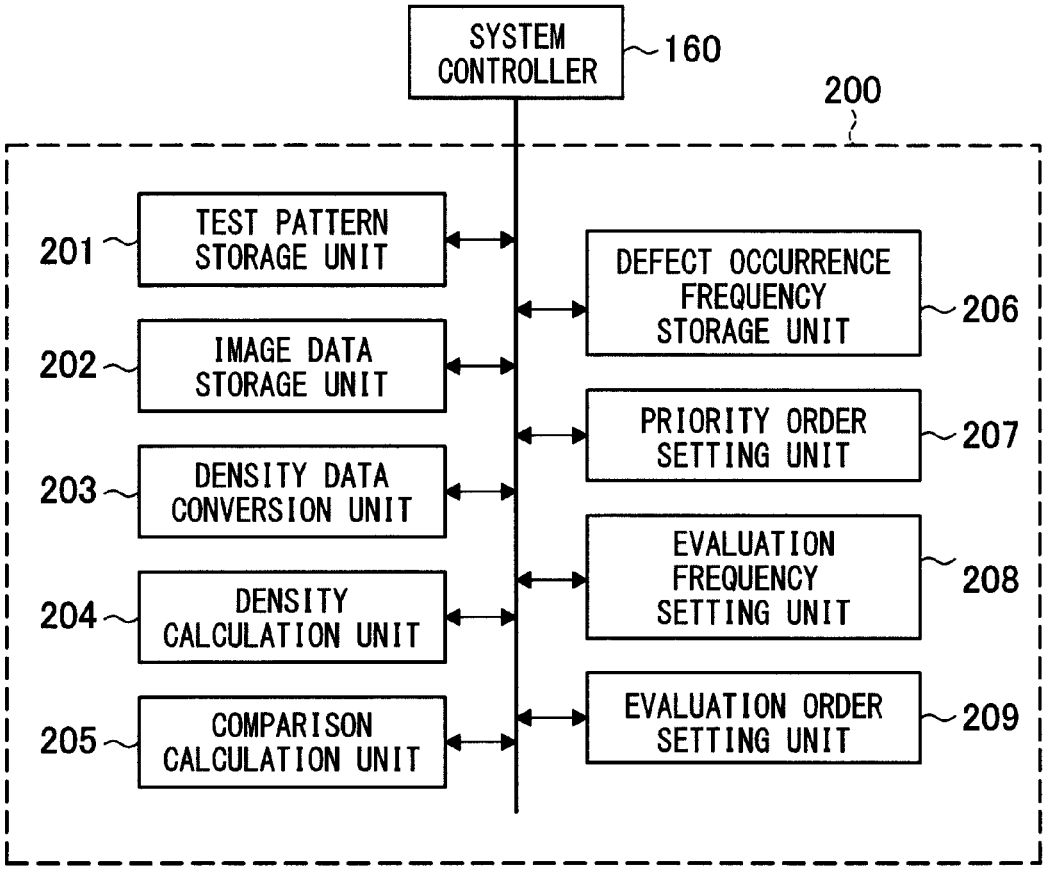
FIG. 6 is a block diagram showing an internal composition of a defective nozzle detection control unit.

FIG. 6 is a block diagram showing the internal composition of the defective nozzle detection control unit 200. As shown in FIG. 6, the defective nozzle detection control unit 200 includes a test pattern storage unit 201, an image data storage unit 202, a density data conversion unit 203, a density calculation unit 204, a comparison calculation unit 205, a defect occurrence frequency storage unit 206, a priority order setting unit 207, an evaluation frequency setting unit 208, an evaluation order setting unit 209, and the like.

The test pattern storage unit 201 stores various test patterns in addition to the test patterns for detecting ink ejection defects and landing deviation relating to the present embodiment (namely, test patterns for defective nozzle detection). The test pattern storage unit 201 sends data of a selected test pattern to the image recording control unit 168 due to an instruction from the system controller 160. The image recording control unit 168 controls driving of the heads 120C, 120M, 120Y and 120K and outputs the test pattern to the printing surface of the paper P. In other words, the image recording control unit 168 functions as a test pattern recording device.

Figure 7:
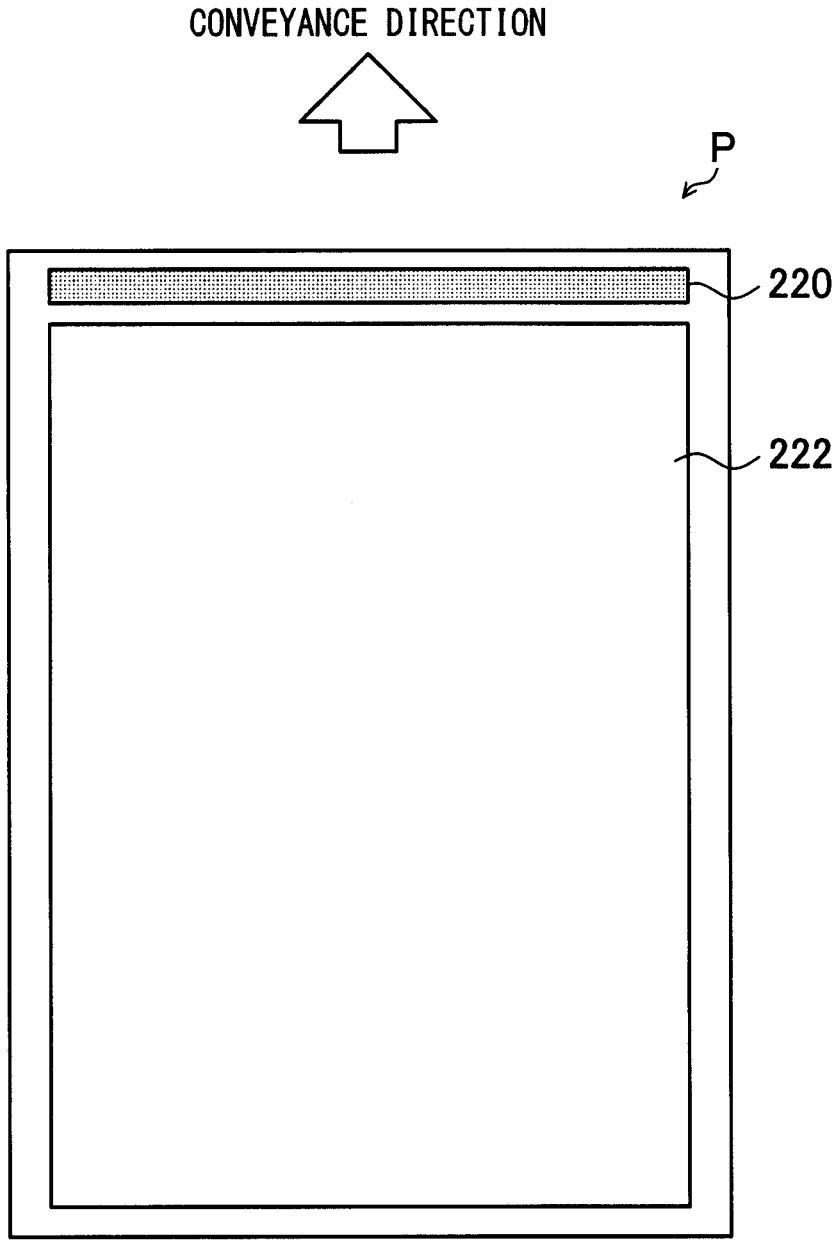
FIG. 7 is an upper surface diagram showing a test pattern recording region on paper P and an output image recording region.

In the present embodiment, the test pattern for defective nozzle detection is recorded on a prescribed region other than the output image region when the output image (main image) is recorded. FIG. 7 is an upper surface diagram of the printing surface of the paper P, and shows a test pattern recording region 220 which is a region where a test pattern is recorded, and an output image recording region 222 which is a region where an output image is recorded. As shown in FIG. 7, the test pattern recording region 220 is arranged through a width corresponding to the nozzle rows of the heads 120, on the upstream side of the output image recording region 222 in terms of the conveyance direction.

The test pattern recording region 220 may also be arranged to the downstream side of the output image recording region 222 in terms of the conveyance direction. Furthermore, it is also possible to adopt a mode in which, rather than providing a test pattern recording region 220 and an output image recording region 222 on the same sheet of paper P, a test pattern recording region 220 is provided over the whole surface of the paper P.

In the test pattern recording region 220, the test pattern is recorded through a prescribed length in the conveyance direction of the paper P, by ejecting ink continuously for a prescribed period of times from all of the nozzles in any one head of the heads 120C, 120M, 120Y and 120K.

The length of the test pattern in the conveyance direction is set in view of the reading speed based on the resolution of the image capturing elements, in other words, the conveyance speed of the paper P, in such a manner that the region from the start to the end of the test pattern is captured completely and clearly. Here, a test pattern of one color is recorded on one sheet of paper P, but if it is possible to record test patterns of a plurality of colors on the test pattern recording region 220, then test patterns for a plurality of colors may be recorded.

Returning to the description in FIG. 6, the test pattern recorded by the image recording unit 100 is captured by the image capturing unit 130, and is stored as inspection image data on the image data storage unit 202.

The density data conversion unit 203 converts the inspection image data read from the image data storage unit 202 into density data, and also splits the data into density data for each pixel row. The density data for each pixel row is substituted for the density characteristics (density data) for each of the nozzles which form the pixel rows.

The density calculation unit 204 calculates an average value of the pixel row density data for one row which has been substituted in density data conversion unit 203. This calculation is carried out for all of the pixel rows.

The comparison calculation unit 205 compares density data calculated by the density calculation unit 204 with a prescribed density threshold value which is set arbitrarily. If the density data is lower (weaker) than the density threshold value, then the nozzle corresponding to the one pixel row used as a basis for calculating the average value of the density is judged to be have an ink ejection defect or landing deviation. On the other hand, if the density data is higher (darker) than the density threshold value, then the nozzle is judged to be a normally functioning nozzle which is in a normally depositing state. In this way, the comparison calculation unit 205 functions as a test pattern analysis device for detecting defective nozzles in the recording head.

For each inkjet head, the defect occurrence frequency storage unit 206 records information, such as the nozzle position in the main scanning direction, as an ink ejection defect and landing deviation inspection history, in respect of nozzles judged to be suffering an ink ejection defect or landing deviation in the comparison calculation unit 205. Moreover, the defect occurrence frequency storage unit 206 is also able to record ink viscosity information, ink vapor pressure information, nozzle diameter data and recording head installation angle data, by inputs from the operating unit 170.

The priority order setting unit 207 calculates an occurrence frequency for each inkjet head from the defective nozzle information stored in the defect occurrence frequency storage unit 206, and sets a priority order for each of the heads 120C, 120M, 120Y and 120K in the defective nozzle inspection, on the basis of this occurrence frequency.

The evaluation frequency setting unit 208 sets an evaluation frequency for defective nozzle inspection of each of the heads 120C, 120M, 120Y and 120K on the basis of the priority order set by the priority order setting unit 207.

The evaluation order setting unit 209 (which corresponds to a control device) sets an evaluation order for defective nozzle inspection of the heads 120C, 120M, 120Y and 120K, on the basis of the evaluation frequency set by the evaluation frequency setting unit 208.

First Embodiment

Next, a defective nozzle detection process according to a first embodiment will be described. In the first embodiment, an evaluation frequency is specified on the basis of the occurrence frequency of ink ejection defects and landing deviation in each of the inkjet heads, and the evaluation order is specified on the basis of this evaluation frequency.

FIG. 8 is a flowchart showing a defective nozzle detection process which is carried out when recording an output image. Here, a case is described in which an output image is printed onto m sheets of paper P.

Firstly, the priority order setting unit 207 reads in the ink ejection defect and landing deviation inspection history stored in the defect occurrence frequency storage unit 206 (step S101). FIG. 9 is a diagram showing an example of an ink ejection defect and landing deviation inspection history. The inspection history 206*a* indicates the number of occurrences of nozzles having an ink ejection defect or landing deviation, for each inkjet head (ink color). The defect occurrence frequency storage unit 206 may store, as an inspection history, an inspection history 206*b* which indicates the number of occurrences of nozzles having an ink ejection defect or landing deviation, for each head module, and an inspection history 206*c* which indicates the number of occurrences of ink ejection defects or landing deviations, for each nozzle.

The priority order setting unit 207 sets a priority order, priority, in sequence from the head having the highest occurrence frequency (number of occurrences) of an ink ejection defect or landing deviation, on the basis of the inspection history 206*a* which is read out from the defect occurrence frequency storage unit 206 in step S101 (step S102). In other words, the priority order is set to: priority order "priority_1" for the head having the highest occurrence frequency, priority order "priority_2" for the head having the second highest occurrence frequency, etc., and priority order "priority_n" for the head having the nth highest occurrence frequency.

According to the inspection history 206*a* shown in FIG. 9, the defect occurrence frequency is highest in head 120C, followed in order by heads 120K, 120Y and 120M. Therefore, the head 120C is set to priority order "priority_1", the head 120K is set to priority order "priority_2", the head 120Y is set to priority order "priority_3" and the head 120M is set to priority order "priority_4".

If there is a plurality of heads having the same occurrence frequency, then the priority order should be set appropriately on the basis of other parameters.

Thereupon, the evaluation frequency setting unit 208 sets an evaluation frequency for each of the heads, on the basis of the priority orders set by the priority order setting unit 207 (corresponding to an evaluation frequency setting step). Here, for example, the evaluation frequency of the head having priority order "priority_1" (head 120C) is set to 40%, the evaluation frequency of the head having priority order "priority_2" (head 120K) is set to 30%, the evaluation frequency of the head having priority order "priority_3" (head 120Y) is set to 20% and the evaluation frequency of the head having priority order "priority_4" (head 120M) is set to 10%. The method of setting the evaluation frequency is not limited to the example described above, and can use an optimal method, as appropriate.

Next, the evaluation order setting unit 209 sets an evaluation order, order, for each head on the basis of the evaluation frequency for each head set by the evaluation frequency setting unit 208 (corresponding to an evaluation order setting step; step S103). Here, since m output images are printed and a test pattern of one color is recorded on one sheet of paper P, then in total m test patterns are recorded. The evaluation order setting unit 209 sets the evaluation order, "order", for each head by assigning the m test patterns in accordance with the evaluation frequencies of the heads (corresponding to a control step).

Here, for example, the head having priority order "priority_1" (head 120C) is set at evaluation order, "order_1", the head having priority order "priority_2" (head 120K) is set at evaluation order, "order_2", the head having priority order "priority_3" (head 120Y) is set at evaluation order, "order_3", the head having priority order "priority_1" (head 120C) is set at evaluation order, "order_4", the head having priority order "priority_4" (head 120M) is set at evaluation order, "order_5", the head having priority order "priority_2" (head 120K) is set at evaluation order, "order_6", . . . , and the head having priority order "priority_3" (head 120Y) is set at evaluation order, "order_m".

When the setting of the evaluation order, order, for each head has been completed, the variable i which corresponds to the number of printed sheets of output images is reset to i=1, and the printing of the output image is started (step S104). In the present embodiment, at the ith sheet of paper P, a test pattern is recorded by the head having evaluation order, "order_i", and defective nozzle detection is carried out.

The image recording unit 100 acquires a test pattern for defective nozzle detection from the test pattern storage unit 201, via the system controller 160. Furthermore, the image recording unit 100 conveys one sheet of paper P by means of the image recording drum 110, and records a test pattern by the head having "order_1" (head 120C) onto the test pattern recording region 220 of the paper P (corresponding to a recording step, step S105). In other words, the test pattern is recorded through a prescribed length in the conveyance direction of the paper P by ejecting ink continuously for a prescribed period of time from all of the nozzles of the head 120C.

Subsequently, the image recording unit 100 records an output image on an output image recording region 222 of the paper P (step S106). As stated previously, the output image data is read in from the host computer 300 via the communication unit 162 and is stored in the image memory 164. The system controller 160 generates dot data by applying prescribed signal processing to the image data stored in the image memory 164, and records an output image on paper P by controlling the driving of the heads 120C, 120M, 120Y and 120K in accordance with the generated dot data.

Next, in the image capturing unit 130, the test pattern which has been recorded on the test pattern recording region 220 by the head having "order_1" is captured (corresponding to an image capturing step; step S107). The captured inspection image data is stored in the image data storage unit 202.

A defective nozzle is detected on the basis of this inspection image data (corresponding to an analysis step; step S108).

More specifically, the inspection image data is converted into density data by the density data conversion unit 203, and the values are averaged for each nozzle corresponding to each pixel, in the density calculation unit 204. This density data is compared with a prescribed density threshold value in the comparison calculation unit 205, and if the density data is lower than the density threshold value, then the nozzle in question is judged to have an ink ejection defect or landing deviation. On the other hand, if the density data is higher than the density threshold value, then the nozzle is judged to be a normally functioning nozzle.

The system controller 160 judges whether or not all of the nozzle are functioning normally, on the basis of these detection results (step S109).

If a defective nozzle is detected, then this detection result is stored in the defect occurrence frequency storage unit 206 and the image recording process (printing process) is terminated. By immediately suspending the image recording process in this way when a defective nozzle has been detected, wastage of paper is avoided. Furthermore, immediately after detecting a defective nozzle, image conversion processing is carried out anew for the purpose of ejection failure correction and density correction, and a cleaning operation (nozzle restoration operation), such as preliminary ejection, suctioning, wiping, or the like, can be carried out in respect of the defective nozzle.

Desirably, as well as terminating the printing process, a notification that the printing process has been terminated is displayed to the user via the display unit 172, or reported via speakers (not illustrated) (corresponding to a reporting step).

If all of the nozzles are normally functioning, then it is judged whether or not the variable i corresponding to the current number of printed sheets exceeds the maximum number of output sheets m (step S110). If the variable i exceeds the maximum number of output sheets m, then since m sheets have been completed, the printing process terminates. If the variable i does not exceed the maximum number of output sheets m, then the variable i is incremented (step S111) and the procedure returns to step S105.

Here, the variable i is incremented to i=2, and the procedure transfers to step S105. The image recording unit 100 records a test pattern by the head having "order_2" (head 120K) on the test pattern recording region 220 of the second sheet of paper P. Furthermore, the image recording unit 100 records an output image on an output image recording region 222 of the paper P (step S106).

Thereafter, similarly, an image of a test pattern is captured by the image capturing unit 130 (step S107), density data for each nozzle is calculated in the density data conversion unit 203 and the density calculation unit 204, and defective nozzles are detected by the comparison calculation unit 205 (step S108).

In this way, inspection of m test patterns is carried out while printing output images onto m sheets of paper P. In this case, the m test patterns are assigned to each head, and the evaluation order is set so as to make the evaluation frequency higher, the higher the occurrence frequency of defective nozzles. Therefore, it is possible to make a greater number of evaluations for a head, the higher the occurrence frequency of defective nozzles in that head. As a result of this, it is possible to raise the statistical probability of detecting a defective nozzle at an early stage.

In the present embodiment, the variable i is incremented and printing is carried out on the next sheet of paper P, i+1, after having judged whether or not all of the nozzles are normally functioning, but the invention is not limited to a case where the next sheet is printed after carrying out this judgment. For example, when carrying out high-speed printing, before making a judgment about the ith sheet of paper P, it is necessary to carry out printing onto the i+1th, i+2th, i+3th, . . . , and i+xth sheets of paper P. In this way, printing may be performed onto the following sheet of paper P without waiting for the result of judgment about defective nozzles.

Even in the case of high-speed printing of this kind, when a defective nozzle has been detected, the image recording process is suspended immediately. Furthermore, immediately after detecting a defective nozzle, image conversion processing can be carried out anew for the purpose of ejection failure correction and density correction, and a cleaning operation (nozzle restoration operation), such as preliminary ejection, suctioning, wiping, or the like, can be carried out in respect of the defective nozzle.

Furthermore, rather than recording a test pattern onto all of the sheets of paper P, it is also possible to record a test pattern every certain number of sheets. For example, it is possible to record a test pattern on a ratio of 1 out of every 5 sheets.

Moreover, in the present embodiment, printing of the output image is started after previously setting an evaluation order, order, for the m test patterns in step S103, but the evaluation order does not have to be set in advance. For example, it is also possible to adopt a composition in which the head outputting a test pattern is specified each time a test pattern is output in step S105, in accordance with the evaluation frequency. Even if a composition of this kind is adopted, the m test patterns can be assigned to the respective heads in accordance with the evaluation frequency.

Modification of First Embodiment

In the first embodiment, a priority order was specified on the basis of the occurrence frequency of ink ejection defects and landing deviation in each head, and an evaluation frequency was specified on the basis of this priority order, but the factors for specifying the priority order are not limited to this. For example, viscosity information relating to the ink of each color may be read in and the priority order may be set in sequence from the ink having the highest viscosity.

Furthermore, vapor pressure information relating to the ink of each color may be read in and the priority order may be set in sequence from the ink having the highest vapor pressure.

Furthermore, data about the nozzle diameter (corresponding to the nozzle hole diameter) of each head may be read in and the priority order may be set in order from the head having the lowest average value of the nozzle diameter.

The nozzles 251 are formed by focusing and irradiating a laser beam onto the recording head. If a plurality of nozzles 251 are formed in one head by using the same laser beam, then there should be a correlation between the plurality of nozzle diameters formed in one head, and therefore the priority order is set here from the head having the smallest average value of the nozzle diameter. It is also possible to set the priority order in sequence from the head having the lowest minimum value of the nozzle diameter in the heads of the respective colors.

Moreover, it is also possible to read in installation angle data when the heads are installed on the inkjet recording apparatus 10 and to set a priority order in sequence from the head having the largest installation angle.

Figure 10:
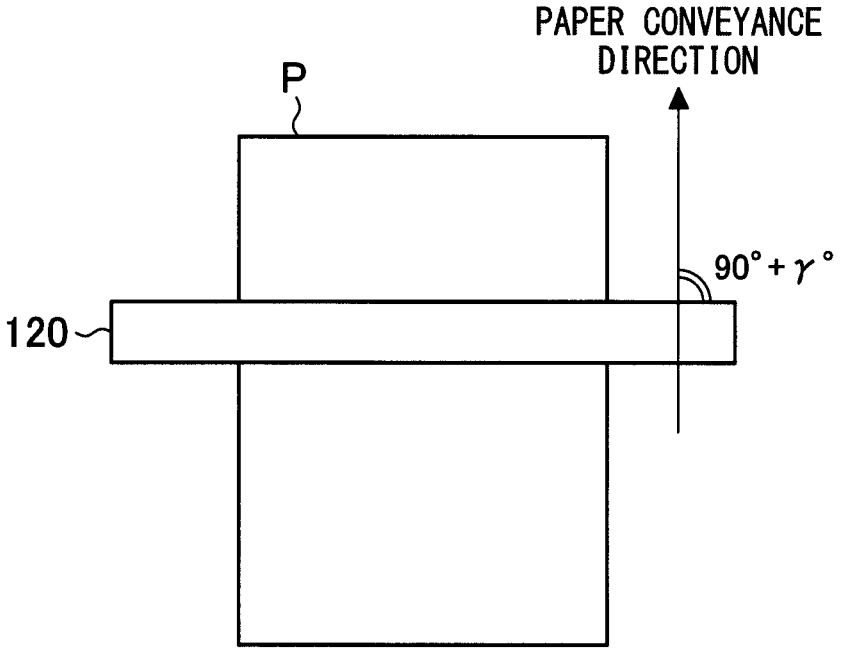
FIG. 10 is a diagram showing one example of an installation error angle of each color head.

FIG. 10 is a diagram showing an angle formed between the head 120 and the conveyance direction of the paper P.

The nozzles 251 of the heads 120C, 120M, 120Y and 120K are arranged along a row direction which forms an angle θ with respect to the main scanning direction, as shown in FIG. 2B, when the heads are installed perpendicularly with respect to the conveyance direction of the paper P by the image recording drum 110. Consequently, it is possible to regard the nozzles 251 as equivalent to a nozzle arrangement at a uniform pitch $P=Ls/\tan\theta$ in the main scanning direction.

Here, as shown in FIG. 10, if there is error in the installation of the heads 120, and the installation angle of a head is $90°+\gamma°$, in other words, a head installation error angle of γ occurs, then lengthening and shortening of the nozzle pitch in the main scanning direction occurs and the nozzle pitch ceases to be uniform. Therefore, setting the priority order in sequence from the head having the largest installation error angle γ is effective in achieving rapid detection of ink ejection defects or landing deviation.

As described above, in a step of designating an analysis frequency when inspecting ink ejection defects and landing deviation, it is possible to use ink viscosity information, ink vapor pressure information, nozzle diameter data and head installation angle data. In this way, even if there is no inspection history information, by using information about factors which give rise to recording defects, it is possible to raise the evaluation frequency of heads which have a high logical probability of producing a recording defect.

Second Embodiment

Figure 11:
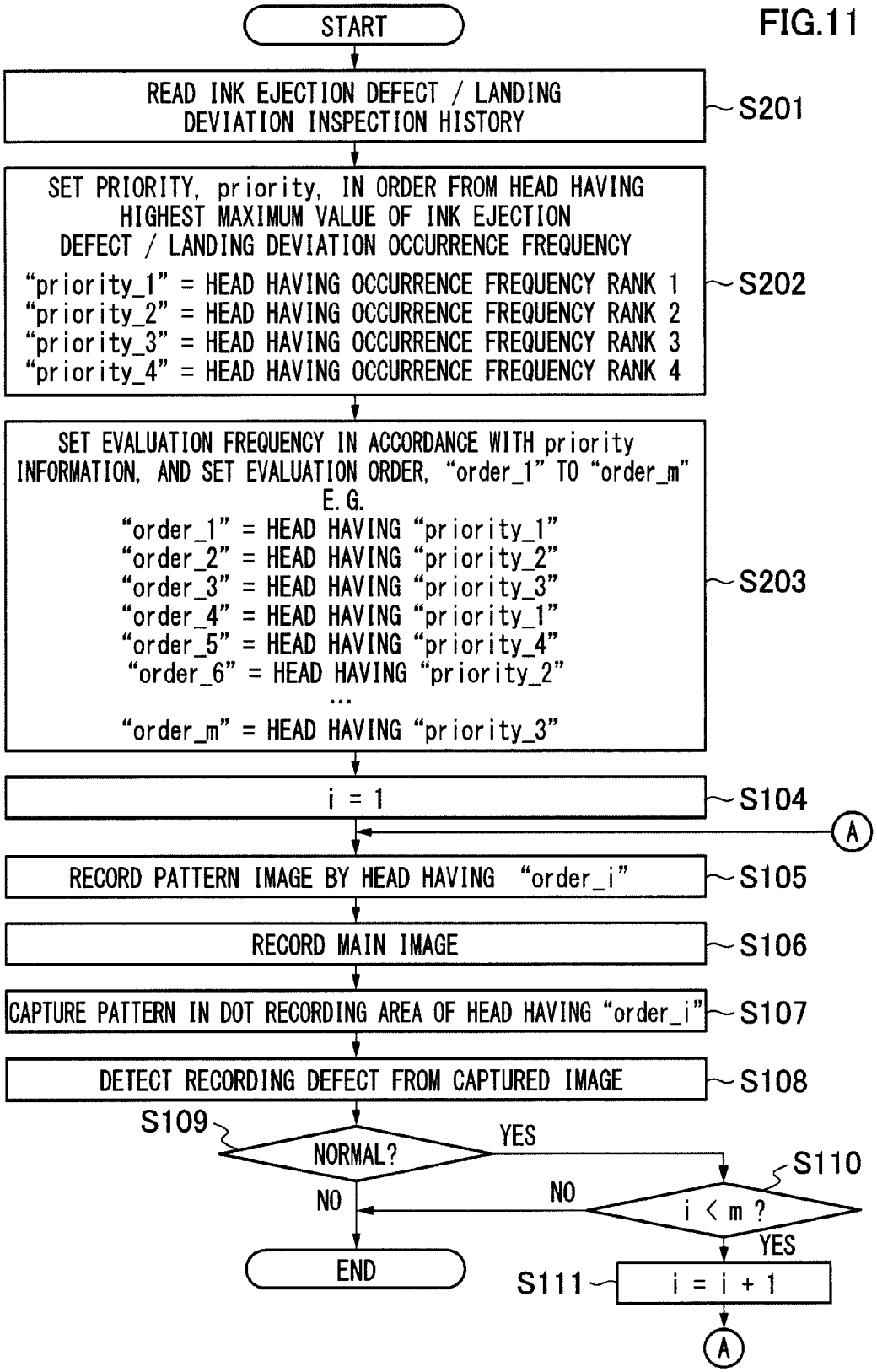
FIG. 11 is a flowchart showing a defective nozzle detection process according to a second embodiment.

FIG. 11 is a flowchart showing a defective nozzle detection process according to a second embodiment. Parts which are the same as or similar to the flowchart shown in FIG. 8 are labeled with the same reference symbols and detailed explanation thereof is omitted here. In the present embodiment, the evaluation frequency is set on the basis of the maximum value of the occurrence frequency for each head, and the evaluation order is set on the basis of this evaluation frequency.

Firstly, the priority order setting unit 207 reads in the ink ejection defect and landing deviation inspection history stored in the defect occurrence frequency storage unit 206 (step S201). In the present embodiment, the priority order setting unit 207 reads in an inspection history 206*c* as shown in FIG. 9. In the example shown here, one head is constituted by six head modules and furthermore, one head module is constituted by 636 nozzles. The inspection history 206*c* shows the number of occurrences of ink ejection defects and landing deviations for each nozzle.

Next, the priority order setting unit 207 sets a priority order, priority, in sequence from the head including the nozzle having the highest value of the occurrence frequency (number of occurrences) of an ink ejection defect or landing deviation, on the basis of the inspection history 206*c* which is read out from the defect occurrence frequency storage unit 206 in step S201 (step S202). In other words, the priority order is set to: priority order "priority_1" for the head including the nozzle having the highest maximum value of the occurrence frequency, priority order "priority_2" for the head including the nozzle having the second highest maximum value of the occurrence frequency, . . . , and priority order "priority_n" for the head including the nozzle having the nth highest maximum value of the occurrence frequency.

If there is a plurality of heads having the same maximum value of the occurrence frequency, then the priority order should be set appropriately on the basis of other parameters.

Thereupon, the evaluation frequency setting unit 208 (corresponding to an evaluation frequency setting step) sets an evaluation frequency for each of the heads, on the basis of the priority orders set by the priority order setting unit 207. There are no restrictions on the method of setting the evaluation frequency and it is possible to use an optimal method, as appropriate.

Next, the evaluation order setting unit 209 sets an evaluation order, order, for each head on the basis of the evaluation frequency for each head set by the evaluation frequency setting unit 208 (step S203). Here, if a test pattern for one head is recorded on one sheet of paper P, when printing the m output images, then in total m test patterns are recorded. The evaluation order setting unit 209 sets the evaluation order, order, for each head by assigning the m test patterns in accordance with the evaluation frequencies of the heads.

For example, the head having priority order "priority_1" is set at evaluation order, "order_1", the head having priority order "priority_2" is set at evaluation order, "order_2", the head having priority order "priority_3" is set at evaluation order, "order_3", the head having priority order "priority_1" is set at evaluation order, "order_4", the head having priority order "priority_4" is set at evaluation order, "order_5", the head having priority order "priority_2" is set at evaluation order, "order_6", . . . , and the head having priority order "priority_3" is set at evaluation order, "order_m".

The processing described below is similar to the processing from step S104 onwards in the flowchart shown in FIG. 8.

In this way, the evaluation frequency is set on the basis of the maximum value of the defective nozzle occurrence frequency in each head, the evaluation order is set on the basis of this evaluation frequency, and defective nozzles are detected by recording test patterns for each head. In this case, the m test patterns are assigned to each head, and the evaluation order is set so as to make the evaluation frequency higher, the higher the maximum value of the defective nozzle occurrence frequency. Therefore, it is possible to make a greater number of evaluations for a head, the higher the maximum value of the defective nozzle occurrence frequency in that head. As a result of this, it is possible to raise the statistical probability of detecting a defective nozzle at an early stage.

Third Embodiment

FIG. 12 is a flowchart showing a defective nozzle detection process according to a third embodiment. Parts which are the same as or similar to the flowchart shown in FIG. 8 are labeled with the same reference symbols and detailed explanation thereof is omitted here. The inkjet recording apparatus 10 relating to the present embodiment is composed so as to be able to eject ink droplets of two dot sizes (droplet types), namely, a large droplet and a small droplet, onto the paper P, in accordance with the drive voltage applied to the individual electrode 257. (In other words, the output image data is quantized into three values: for a large droplet, a small droplet and no droplet.) Here, the priority order, "priority", is set by taking account of the droplet type information.

Firstly, the priority order setting unit 207 reads in the ink ejection defect and landing deviation inspection history which is stored in the defect occurrence frequency storage unit 206 (step S401). FIG. 13 is a diagram showing an example of an ink ejection defect and landing deviation inspection history. The inspection history 206*d* indicates the number of occurrences of nozzles having an ink ejection defect or landing deviation, for each inkjet head (ink color) and for each droplet type.

The priority order setting unit 207 sets a priority order, "priority", in sequence from the combination of head and droplet type having the highest occurrence frequency (number of occurrences) of an ink ejection defect or landing deviation, on the basis of the inspection history 206*d* which is read out from the defect occurrence frequency storage unit 206 in step S401 (step S402). In other words, the priority order is set in such a manner that priority order "priority_1" is set for the combination of head and droplet type having the highest occurrence frequency, priority order "priority_2" is set for the combination of head and droplet type having the second highest occurrence frequency, priority order "priority_3" is set for the combination of head and droplet type having the third highest occurrence frequency, . . . , and priority order "priority_n" is set for the head having the nth highest occurrence frequency.

According to the inspection history 206*d* shown in FIG. 13, the defect occurrence frequency is highest for a combination of head 120C and large droplet, followed sequentially by head 120K and large droplet, head 120C and small droplet, head 120Y and large droplet, head 120M and large droplet, head 120K and small droplet, head 120Y and small droplet, and head 120M and small droplet. Consequently, the combination of head 120C and large droplet is set to priority order "priority_1", the combination of head 120K and large droplet is set to priority order "priority_2", the combination of head 120C and small droplet is set to priority order "priority_3", the combination of head 120Y and large droplet is set to priority order "priority_4", . . . , and the combination of head 120M and small droplet is set to priority order "priority_8".

If there is a plurality of heads having the same occurrence frequency, then the priority order should be set appropriately on the basis of other parameters.

Consequently, the evaluation frequency setting unit 208 sets an evaluation frequency for each combination of head and droplet type, on the basis of the priority order set by the priority order setting unit 207. Next, the evaluation order setting unit 209 sets an evaluation order, order, for the combinations of head and droplet type, on the basis of the evaluation frequencies for the combinations of head and droplet type set in the evaluation frequency setting unit 208 (step S403).

The image recording unit 100 records a test pattern on the test pattern recording region 220 of the paper P by the combination of head and droplet type having "order_n." In other words, the test pattern is recorded through a prescribed length in the conveyance direction of the paper P by ejecting ink continuously for a prescribed period of time from all of the nozzles of the corresponding head, using the corresponding droplet type.

The operation thereafter is similar to that of the flowchart shown in FIG. 8. When a defective nozzle has been detected at step S108, the combination of that defective nozzle and the droplet type is stored in the defect occurrence frequency storage unit 206 as a detection result.

The example described above relates to an inkjet recording apparatus which ejects ink droplets of two dot sizes, a large droplet and a small droplet, but the types of dot size are not limited to two sizes. For instance, it is also possible to employ an inkjet recording apparatus which ejects ink droplets of three dot sizes, namely, a large droplet, a medium droplet and a small droplet, or an inkjet recording apparatus which ejects ink droplets of a greater number of dot sizes than this.

Furthermore, a priority order, priority, for each combination of head and droplet type is set by using an inspection history which indicates the number of occurrences of nozzles having an ink ejection defect or landing deviation, for each head (ink color) and each droplet type, but it is also possible to set a priority order, priority, for each combination of head and droplet type on the basis of the maximum value of the occurrence frequency for each nozzle and each droplet type, by using an inspection history which indicates the number of occurrences of ink ejection defects and landing deviations for each nozzle and each droplet type.

Furthermore, in the present embodiment, a priority order is specified for combinations of head and droplet type, on the basis of an inspection history, but it is also possible to specify a priority order by considering the defective nozzle occurrence frequency to be higher, the greater the droplet amount (ink amount) for the droplet type.

Fourth Embodiment

Figure 14:
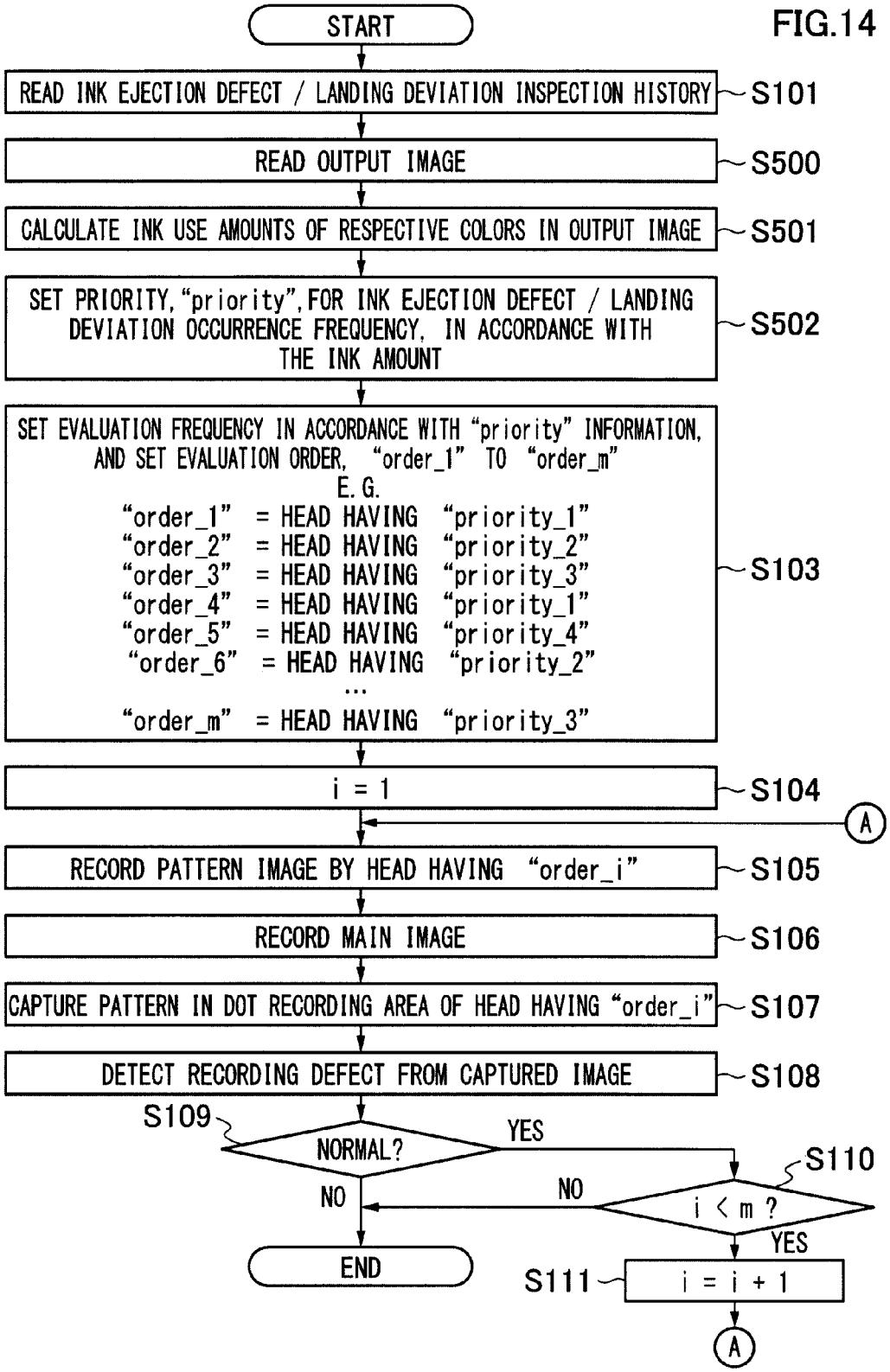
FIG. 14 is a flowchart showing a defective nozzle detection process according to a fourth embodiment.

FIG. 14 is a flowchart showing a defective nozzle detection process according to a fourth embodiment. Parts which are the same as or similar to the flowchart shown in FIG. 8 are labeled with the same reference symbols and detailed explanation thereof is omitted here. The inkjet recording apparatus 10 relating to the present embodiment sets a priority order, priority, in accordance with the output image data.

Firstly, the priority order setting unit 207 reads in the ink ejection defect and landing deviation inspection history which is stored in the defect occurrence frequency storage unit 206 (step S101). For example, the priority order setting unit 207 reads in an inspection history 206*a* as shown in FIG. 9.

Subsequently, the priority order setting unit 207 acquires output image data stored in the image memory 164 via the system controller 160 (step S500), and calculates the ink use amount for each head (each color) which is used in printing the output image (step S501).

The priority order setting unit 207 sets a priority order, "priority", on the basis of inspection history 206*a* which has been read in from the defect occurrence frequency storage unit 206 at step S101, and an ink use amount for each color calculated at step S501 (step S502). For instance, the priority order, priority, is set by weighting the number of occurrences for each color of the inspection history 206*a*, in accordance with the ink use amount of each color in the output image.

If the ratio of the ink use amounts of each color in the output image are, respectively, cyan (C)=10%, magenta (M)=25%, yellow (Y)=35% and black (K)=30%, then the number of occurrences for each color obtained by weighting the inspection history 206*a* are: cyan (C)=20.3, magenta (M)=12, yellow (Y)=30.1 and black (K)=44.7. Consequently, it is possible to set the priority order in sequence from the head having the highest number of occurrences after weighting, so that the head 120K is set to priority order "priority_1", the head 120Y is set to priority order "priority_2", the head 120C is set to priority order "priority_3", and the head 120M is set to priority order "priority_4".

The method of setting the priority order, "priority", on the basis of the ink use amount for each color is not limited to the example given above.

The operation thereafter is similar to that of the flowchart shown in FIG. 8. The evaluation frequency setting unit 208 can weight the number of occurrences of each color in the inspection history 206*a*, in accordance with the ink use amount of each color in the output image, and set the ratio of the weighted number of occurrences as the evaluation frequency.

In this way, it is possible to raise the statistical probability of detecting a defective nozzle at an early stage, by calculating the ink use amount of each head in the output image, setting a priority order, priority, on the basis of the ink use amount and the defective nozzle occurrence frequency of each head, and raising the evaluation frequency, the higher the priority order, "priority", of the head.

Modification of First to Fourth Embodiments

In the flowcharts shown in FIG. 8, FIG. 11, FIG. 12 and FIG. 14, desirably, processing is carried out as described below, when detecting defective nozzles on the basis of the inspection image data (step S108).

More specifically, in the case of the flowcharts shown in FIG. 8, FIG. 12 and FIG. 14, processing is carried out sequentially from the head module having the highest defective nozzle occurrence frequency, by using the inspection history 206*b*. Furthermore, it is also possible to carry out processing sequentially from the head module having the highest maximum value of the defective nozzle occurrence frequency, by using the inspection history 206*c*. Moreover, it is also possible to carry out processing sequentially from the nozzle having the highest defective nozzle occurrence frequency.

In the case of the flowchart shown in FIG. 11, the processing in step S108 is carried out sequentially from the nozzle having the highest defective nozzle occurrence frequency, by using the inspection history 206*c*.

By preferentially inspecting head modules or nozzles having a high statistical probability of producing a recording defect, using an ink ejection defect and landing deviation inspection history, when detecting defective nozzles on the basis of inspection image data, it is possible to further raise the statistical probability of detecting a defective nozzle at an early stage.

Fifth Embodiment

Figure 15:
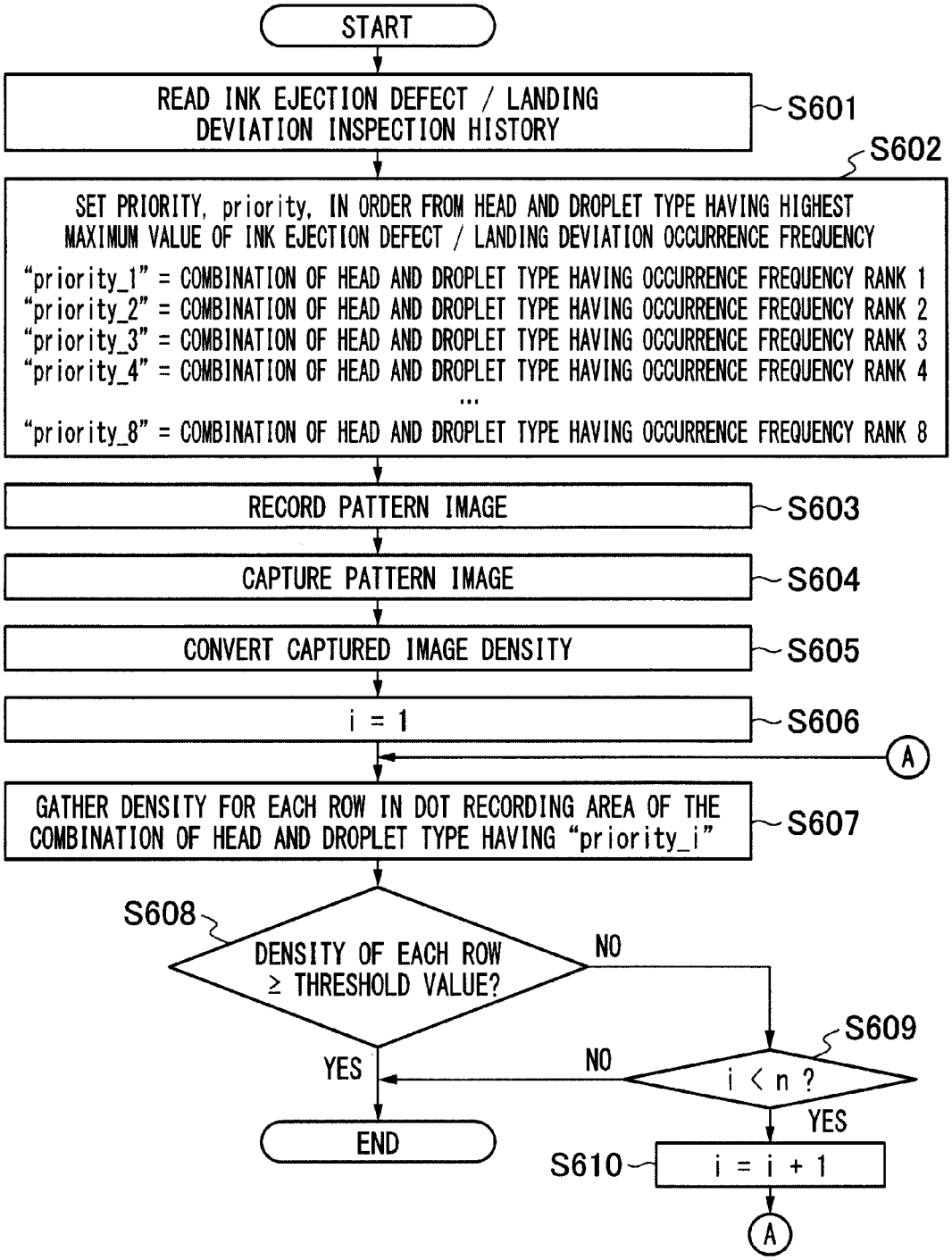
FIG. 15 is a flowchart showing a defective nozzle detection process according to a fifth embodiment.

FIG. 15 is a flowchart showing a defective nozzle detection process according to a fifth embodiment. In the present embodiment, a priority order, "priority", is set on the basis of the occurrence frequency of an ink ejection defect or landing deviation in each head, and on the basis of droplet type information, and detection of defective nozzles is carried out in accordance with this priority order, priority.

Firstly, the priority order setting unit 207 reads in the ink ejection defect and landing deviation inspection history which is stored in the defect occurrence frequency storage unit 206 (step S601). FIG. 16 is a diagram showing an example of an ink ejection defect and landing deviation inspection history. The inspection history 206*e* indicates the number of occurrences of nozzles having an ink ejection defect or landing deviation, for each head and for each droplet type.

The priority order setting unit 207 sets a priority order, "priority", in sequence from the combination of head and droplet type having the highest occurrence frequency (number of occurrences) of an ink ejection defect or landing deviation, on the basis of the inspection history 206*e* which is read out from the defect occurrence frequency storage unit 206 in step S601 (step S602). In other words, the priority order is set in such a manner that priority order "priority_1" is set for the combination of head and droplet type having the highest occurrence frequency, priority order "priority_2" is set for the combination of head and droplet type having the second highest occurrence frequency, priority order "priority_3" is set for the combination of head and droplet type having the third highest occurrence frequency, . . . , and priority order "priority_n" is set for the head having the nth highest occurrence frequency.

The image recording unit 100 acquires a test pattern for defective nozzle detection from the test pattern storage unit 201, via the system controller 160, and records this test pattern (step 603).

Figure 17:
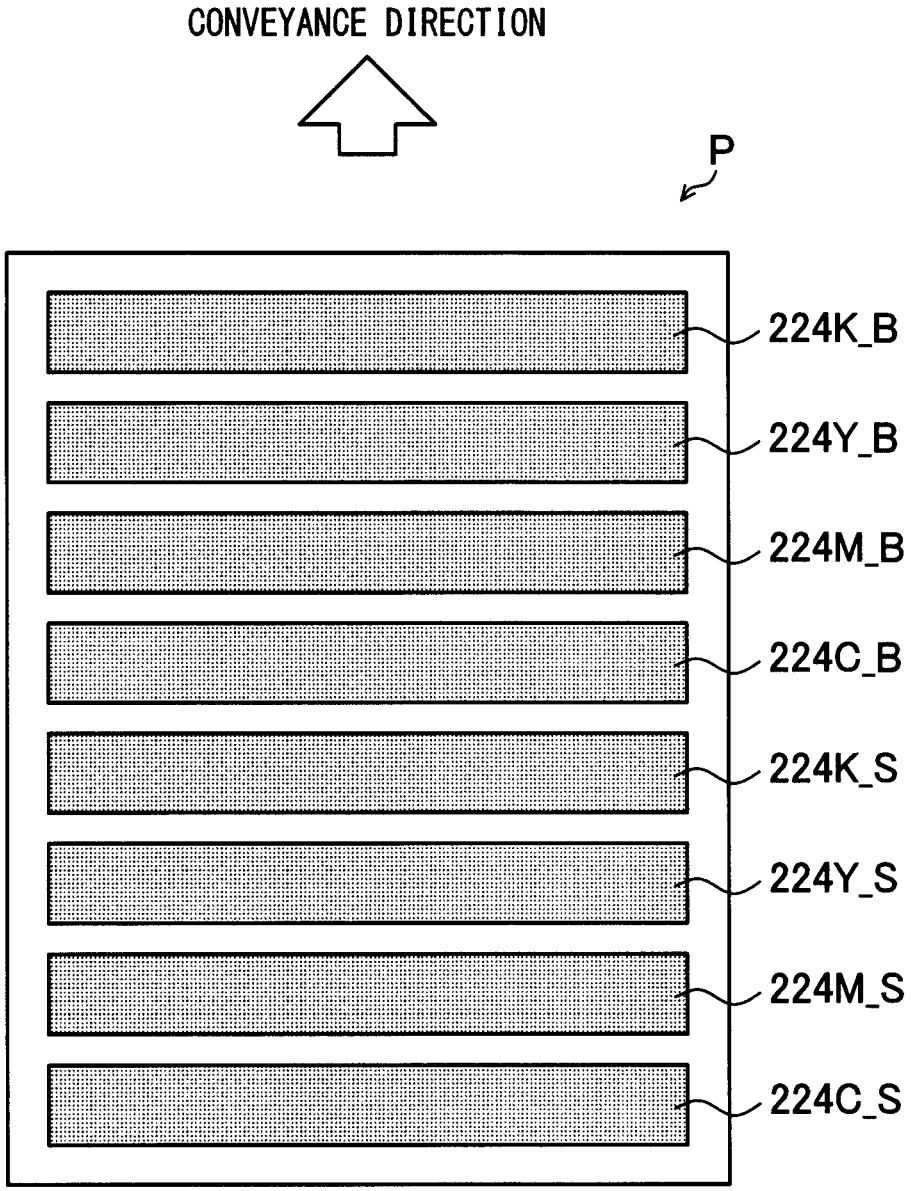
FIG. 17 is a diagram showing test patterns recorded on paper P according to a fifth embodiment.

The test pattern according to the present embodiment is recorded on paper P separately from the output image. FIG. 17 is a diagram showing a test pattern that has been recorded on paper P. As shown in FIG. 17, the test pattern according to the present embodiment is constituted by: a region 224C_B recorded by large droplets from head 120C, a region 224C_S recorded by small droplets from head 120C, a region 224M_B recorded by large droplets from head 120M, a region 224M_S recorded by small droplets from head 120M, a region 224Y_B recorded by small droplets from head 120Y, a region 224Y_S recorded by small droplets from head 120Y, a region 224K_B recorded by large droplets from head 120K, and a region 224K_S recorded by small droplets from head 120K.

In this way, a test pattern having respective regions recorded by the combinations of the respective heads 120C, 120M, 120Y and 120K and droplet types is captured by the image capturing unit 130 (step S604). The captured inspection image data is stored in the image data storage unit 202.

Moreover, the inspection image data stored in the image data storage unit 202 is subjected to density conversion in the density data conversion unit 203 (step 605). When density conversion has been completed, the variable i which corresponds to the number of analysis areas for defective nozzle detection is reset to i=1 (step S606).

Next, the density calculation unit 204 calculates the average value or cumulative value of the density, in row units along the sub-scanning direction of the recorded region corresponding to the head having priority order "priority_i" set in step S602 (step S607). Here, firstly, the average value or cumulative value of the density is calculated for the recorded region corresponding to the head having priority order "priority_1".

This density data is compared with a prescribed density threshold value in the comparison calculation unit 205, and if the density data is lower than the density threshold value, then the nozzle in question is judged to have an ink ejection defect or landing deviation. On the other hand, if the density data is higher than the density threshold value, then the nozzle is judged to be a normally functioning nozzle.

If the density data is lower than the density threshold value (YES at step S608), then the nozzle is judged to have an ink ejection defect and landing deviation, and the defective nozzle detection process is terminated. By terminating inspection when an ink ejection defect or landing deviation has been detected, as well as carrying out inspection preferentially by starting from a recording region corresponding to a head having a high statistical probability of producing an ink ejection defect or landing deviation, it is possible to shorten the inspection time compared to a case where the whole of the image is inspected in an arbitrary order.

Rather than terminating the defective nozzle detection process, it is also possible to continue the defective nozzle detection process until inspection has been completed for the regions of all of the combinations of head and droplet type. By carrying out a full inspection, it is possible to leave an accurate inspection history in the defect occurrence frequency storage unit 206.

If the density data for the region in question is higher than the density threshold value in all cases (NO at step S608), then it is judged whether or not the variable i is greater than the number of all combinations of heads and droplet types, n (step S609). If the variable i is greater than n, then all of the nozzles are functioning normally, and therefore the defective nozzle detection process is terminated. If the variable i is smaller than n, then the variable i is incremented (step S610) and the procedure returns to step S607.

Here, the variable i is incremented to i=2, and the procedure transfers to step S607. The density calculation unit 204 calculates the average value or cumulative value of the density for the recorded region corresponding to the head having priority order "priority_2". Thereafter, processing is continued in a similar fashion.

In this way, the density calculation unit 204 calculates the average value or the cumulative value of the density of each row of the recording regions corresponding to the respective heads, in a sequence that corresponds to the priority order "priority_n" set in the step S602.

By designating the order in which the density of the recording regions is gathered on the basis of the occurrence frequency of ink ejection defects and landing deviations for each head and each droplet type, as in the present embodiment, it is possible to raise the statistical probability of detecting an ink ejection defect or a landing deviation at an early stage of the inspection process, despite the fact that the factors giving rise to an ink ejection defect or landing deviation are many and varied.

Sixth Embodiment

Figure 18:
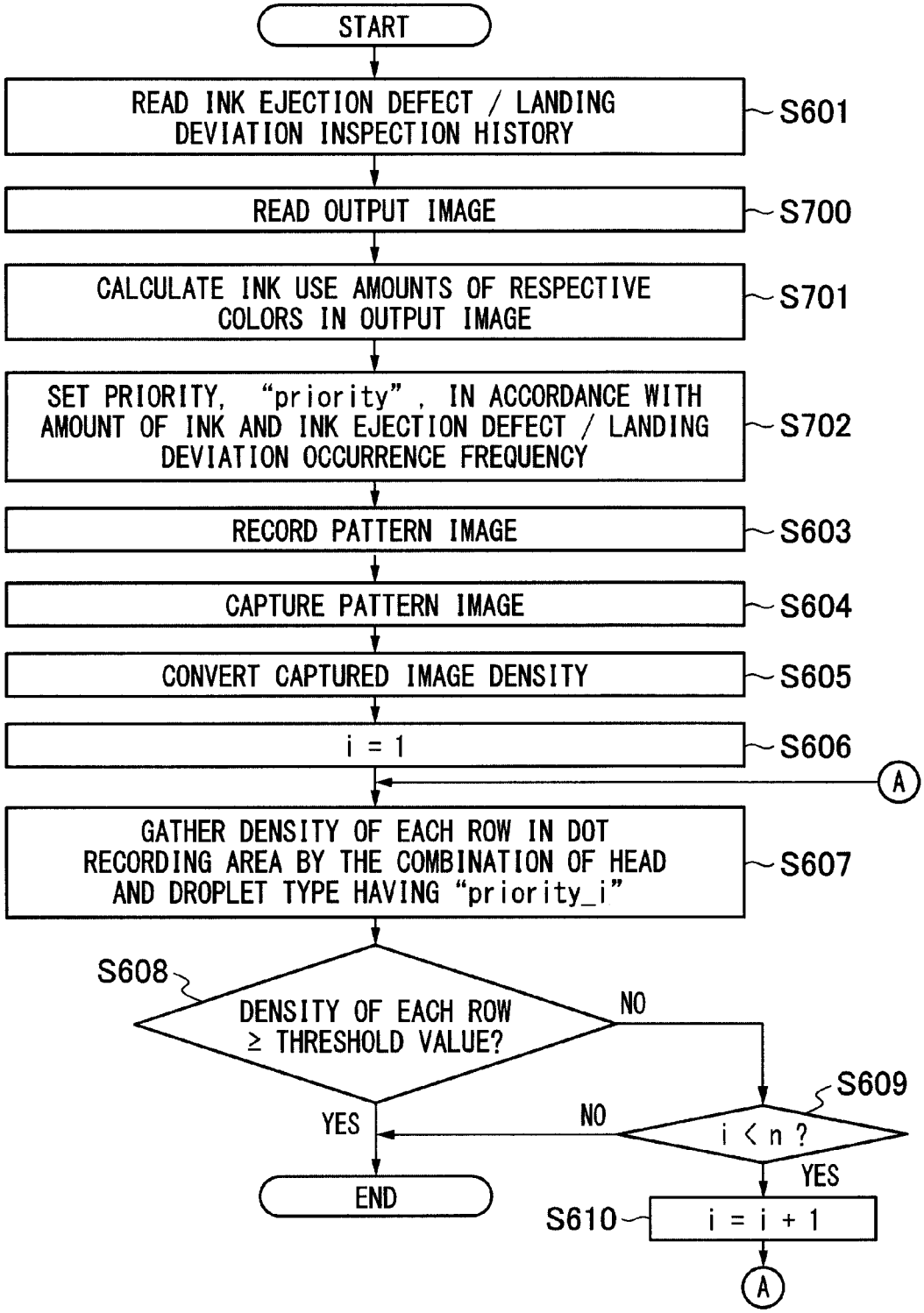
FIG. 18 is a flowchart showing a defective nozzle detection process according to a sixth embodiment.

FIG. 18 is a flowchart showing a defective nozzle detection process according to a sixth embodiment. Parts which are the same as or similar to the flowchart shown in FIG. 15 are labeled with the same reference symbols and detailed explanation thereof is omitted here. In the present embodiment, a priority order, "priority", is set on the basis of the occurrence frequency of an ink ejection defect or landing deviation in each head, and on the basis of the output image data, and detection of defective nozzles is carried out in accordance with this priority order, priority.

Firstly, the priority order setting unit 207 reads in the ink ejection defect and landing deviation inspection history which is stored in the defect occurrence frequency storage unit 206 (step S601). Here, the inspection history 206*a* shown in FIG. 9 is used, for example.

Subsequently, the priority order setting unit 207 acquires output image data stored in the image memory 164 via the system controller 160 (step S700), and calculates the ink use amount for each head (each color) which is used in printing the output image (step S701).

Moreover, the priority order setting unit 207 sets a priority order, priority, on the basis of inspection history which has been read in from the defect occurrence frequency storage unit 206 at step S601, and an ink use amount for each color calculated at step S701 (step S702). For instance, the priority order, "priority", is set by weighting the number of occurrences for each color of the inspection history 206*a*, in accordance with the ink use amount of each color in the output image.

The operation thereafter is similar to that of the flowchart shown in FIG. 15.

By designating the order in which the density of the recording regions is gathered on the basis of the ink use amount for each color in the output image, as in the present embodiment, it is possible to raise the statistical probability of detecting an ink ejection defect or a landing deviation at an early stage of the inspection process, despite the fact that the factors giving rise to an ink ejection defect or landing deviation are many and varied.

The technical scope of the present invention is not limited to the range stated in the embodiments described above. The compositions, and the like, in the respective embodiments can be combined suitably between the respective embodiments within a range that does not depart from the essence of the present invention.

Although a configuration with the four standard colors of C, M, Y and K is described in the embodiments described above, the combinations of the ink colors and the number of colors are not limited to these. Light and/or dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

Furthermore, the present embodiments were described with reference to application to an inkjet recording apparatus, but the scope of application of the present invention is not limited to this. More specifically, the present invention can also be applied to image recording apparatuses of a type other than an inkjet recording apparatus, such as a thermal transfer recording apparatus which is equipped with a recording head using thermal elements as recording elements, an LED electrophotographic printer equipped with a recording head using LED elements as recording elements, or a silver halide photographic printer which uses an LED line exposure head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A recording defect inspection method for an image recording apparatus, comprising:

a recording step of sequentially recording test patterns of respective recording heads onto a recording medium;

an image capturing step of capturing an image of a test pattern recorded on the recording medium by means of a scanner;

an analysis step of analyzing the captured test pattern and detecting a recording defect of the recording head which has recorded the test pattern;

an evaluation frequency setting step of setting an evaluation frequency for each of the recording heads on the basis of a recording defect occurrence frequency for each recording head, the evaluation frequency being higher as the recording defect occurrence frequency increases; and a control step of setting a frequency of analysis and detection for each of the recording heads in the analysis step to the set evaluation frequency, wherein the control step includes an evaluation order setting step of setting an evaluation order by assigning m test patterns, wherein m is a positive integer which is more than a number of the recording head for each recording head on the basis of the set evaluation frequency, and the recording step records the test pattern by at least one recording head for one recording medium in recording an output image, and records the m test patterns on the basis of the set evaluation order.

2. The recording defect inspection method for an image recording apparatus as defined in claim 1, wherein the evaluation frequency setting step sets a priority order for each recording head on the basis of a recording defect occurrence frequency of each recording head, and sets an evaluation frequency for each recording head on the basis of the set priority order.

3. The recording defect inspection method for an image recording apparatus as defined in claim 1, wherein the evaluation frequency setting step acquires information relating to factors causing a recording defect; and the recording defect occurrence frequency is calculated on the basis of the acquired information.

4. The recording defect inspection method for an image recording apparatus as defined in claim 3, wherein the information relating to factors causing a recording defect is recording defect history information of the respective recording heads.

5. The recording defect inspection method for an image recording apparatus as defined in claim 3, wherein the information relating to factors causing a recording defect is information relating to image data that is to be output.

6. The recording defect inspection method for an image recording apparatus as defined in claim 3, wherein the recording head records on the recording medium by ink; and the information relating to factors causing a recording defect is the viscosity of the respective inks.

7. The recording defect inspection method for an image recording apparatus as defined in claim 3, wherein the recording head records on the recording medium by ink; and the information relating to factors causing a recording defect is vapor pressures of the respective inks.

8. The recording defect inspection method for an image recording apparatus as defined in claim 3, wherein the recording head has a plurality of nozzles which eject ink by an inkjet method; and the information relating to factors causing a recording defect is nozzle hole diameters of the respective recording heads.

9. The recording defect inspection method for an image recording apparatus as defined in claim 3, wherein the information relating to factors causing a recording defect is an installation angle of the respective recording heads on a main body of the image recording apparatus.

10. The recording defect inspection method for an image recording apparatus as defined in claim 1, wherein the recording head can record dot sizes of at least two types, and wherein the evaluation frequency setting step sets an evaluation frequency for each combination of a dot size and a recording head, on the basis of a recording defect occurrence frequency for each combination of the dot size and recording head;

the recording step sequentially records a test pattern for each combination of the dot size and recording head, on a recording medium; and the control step sets the frequency of analysis and detection for each combination of the dot size and the recording head in the analysis step to the set evaluation frequency.

11. The recording defect inspection method for an image recording apparatus as defined in claim 1, further comprising a reporting step of immediately issuing a report that a recording defect has been detected, when a recording defect is detected in the analysis step.

12. The recording defect inspection method for an image recording apparatus as defined in claim 1, wherein the analysis step immediately terminates analysis, when a recording defect has been detected.

13. The recording defect inspection method for an image recording apparatus as defined in claim 1, wherein the recording step records m test patterns for m recording mediums.

14. The recording defect inspection method for an image recording apparatus as defined in claim 13, wherein the recording step records the test pattern and the output image by conveying the recording medium in a conveyance direction relative to the recording head only one time, and the test pattern recording region is arranged on an upstream side or a downstream side of the output image recording region in terms of the conveyance direction.

15. The recording defect inspection method for an image recording apparatus as defined in claim 1, wherein the recording step records the test pattern in a recording region of the recording medium, and records an output image in an output image recording region of the recording medium.

16. An image recording apparatus, comprising:

a plurality of recording heads;

an evaluation frequency setting device which sets an evaluation frequency for each recording head on the basis of a recording defect occurrence frequency for each of the recording heads, the evaluation frequency being higher as the recording defect occurrence frequency increases;

a test pattern recording device which sequentially records a test pattern for each of the recording heads onto a recording medium;

an image capturing device which captures an image of a test pattern recorded on the recording medium;

an analysis device which analyzes the image-captured test pattern to detect a recording defect in the recording head which has recorded the test pattern; and a control device which sets the set evaluation frequency as a frequency of analysis and detection for each of the recording heads by the analysis device;

wherein the control device sets an evaluation order by assigning m test patterns wherein m is a positive integer which is more than a number of the recording head for each recording head on the basis of the set evaluation frequency, and the recording heads record the test pattern by at least one recording head for one recording medium in recording an output image, and records the m test patterns on the basis of the set evaluation order.

* * * * *